US005760324A

United States Patent [19]

Wakuda et al.

[11] Patent Number: 5,760,324

[45] Date of Patent: Jun. 2, 1998

[54] AUTOMATIC PERFORMANCE DEVICE WITH SOUND STOPPING FEATURE

[75] Inventors: Sadamoto Wakuda, Shizuoka; Yoshihisa Shimada, Hamamatsu, both of Japan

[73] Assignee: Kawai Musical Instruments Manufacturing Co., Ltd., Hamamatsu, Japan

[21] Appl. No.: 680,865

[22] Filed: Jul. 16, 1996

[30] Foreign Application Priority Data

| | | | |
|---|---|---|---|
| Jul. 28, 1995 | [JP] | Japan | 7-212543 |
| Jul. 28, 1995 | [JP] | Japan | 7-212544 |
| Aug. 1, 1995 | [JP] | Japan | 7-215301 |
| Aug. 17, 1995 | [JP] | Japan | 7-231972 |

[51] Int. Cl.[6] ..... G10H 7/00

[52] U.S. Cl. ..... 84/612; 84/636

[58] Field of Search ..... 84/609, 612, 627, 84/634, 636, DIG. 25

[56] References Cited

U.S. PATENT DOCUMENTS

| | | | |
|---|---|---|---|
| 4,402,244 | 9/1983 | Nakada et al. | 84/612 |
| 5,488,196 | 1/1996 | Zimmerman et al. | 84/612 |
| 5,565,640 | 10/1996 | Hasebe | 84/612 |
| 5,600,082 | 2/1997 | Torimura | 84/610 |

*Primary Examiner*—William M. Shoop, Jr.
*Assistant Examiner*—Jeffrey W. Donels
*Attorney, Agent, or Firm*—Christie, Parker & Hale, LLP

[57] ABSTRACT

An automatic performance apparatus with the concert magic function includes a memory for storing automatic performance data composed of a sequence of note data. Each note data includes a data of gate time and a data of step time. When it is detected that at least one of the keys corresponding to the sequence of note data is pushed, a current note data of the sequence is read out from the memory. Then, there are executed a sound generation stopping process for a previous note data and a sound generating process for the current note data. When it is detected that all of keys corresponding to the sequence of note data are released, a sound generation stopping instruction is issued and the sound generation for the current note data is stopped in the response to the sound generation stopping instruction. The sound generating process and the sound generation stopping process are executed using a reference time period which is determined based on a tempo. The tempo can be changed on the way of performance of a music.

30 Claims, 18 Drawing Sheets

Fig. 9

NOTE DATA FORMAT

| | |
|---|---|
| FIRST BYTE | KEY NUMBER |
| SECOND BYTE | STEP TIME |
| THIRD BYTE | GATE TIME |
| FOUTH BYTE | VELOCITY/PART |

AUTOMATIC PERFORMANCE DEVICE WITH SOUND STOPPING FEATURE

BACKGROUND OF THE INVENTION

1. Field of the Invention

The present invention relates to an automatic performance device with a concert magic function and a method for the same, and more particularly, to a feature for stopping sound generation in the automatic performance device.

2. Description of the Related Art

In a conventional automatic performance apparatus, automatic performance data is stored in automatic performance data memory in advance. When an automatic performance starting switch is operated, the automatic performance data is sequentially read out from the memory and music is performed based on the read out automatic performance data. More particularly, the automatic performance data which is stored in the memory is composed as a sequence of data, and one sound is generated based on each data (the data is referred to as "note data" hereinafter). Each note data is composed of 1-byte data of key number, 1-byte of data corresponding to step time, 1-byte of data corresponding to gate time, and 1-byte of data corresponding to speed/part. For example, the "key number" is the number which is assigned to each key of a keyboard unit and is the data which is used to specify a pitch (an interval) of the generated sound. The "step time" is the data which is used to specify the speed of the performance, especially, the timing of start of the sound generation and the "gate time" is the data which is used to specify in time the endurance of the sound which is generated. Of the "velocity/part", the "velocity" is composed of, for example, 5 bits and is the data which is used to specify the intensity of sound. Also, the "part" is composed of, for example, 3 bits and is the data which is used to specify the part which the sound belongs to. The automatic performance data for one piece of music is composed of a sequence of note data which are arranged in order of step times.

When an automatic performance is started, a count up operation of a step time counter is started. The step time counter is incremented every step time. When a tempo is determined, the step time can be arbitrarily defined as, for example, 1/24, 1/48 or 1/96 of one of times of the tempo. Thus, the actual time period of one step time is determined based on the tempo. Therefore, the actual time period of the one step time is determined in accordance with the tempo.

In the state in which the step time counter operates, one note data is read out from the automatic performance data memory. The step time data of the readout note data and the content of the step time counter are compared. When they do not coincide, the note data is determined not to have reached the timing of sound generation. After that, the comparing operation is repeated every step time. The content of the step time counter is incremented while the comparing operation is repeated. When the step time data of the read-out note data and the content of step time counter coincide, the note data is determined to have reached the timing of sound generation and the sound generation process is performed. In the sound generation process, one sound is generated to have the height which is specified by the key number of the note data and to have the intensity which is specified by the velocity of the note data. When the sound generation process for one note data is completed, the next note data is read out from the automatic performance data memory and the same processes as described above are repeated.

On the other hand, the sound generation is stopped when the time period specified by the gate time of the note data has elapsed. The stop of sound generation is performed as follows. The gate time data of the note data which is subjected to the sound generation is set in a gate time counter. The gate time counter is decremented every step time, independent of the sound generation process. The sound generation is stopped when the content of the gate time counter becomes zero. As above-mentioned, one piece of music is automatically performed by executing the sound generation start process and the sound generation stop process one after another.

In recent years, an automatic performance apparatus with a concert magic function to which the technique of the automatic performance apparatus is applied has been developed. Here, in the "concert magic function", the note data is sequentially read out from the memory at the timing instructed by a player, e.g., the timing at which a key is pushed, and sound generation is started based on the note data. In the automatic performance apparatus with the concert magic function, generally, the automatic performance data which is used in the above-mentioned normal automatic performance apparatus is used in a concert magic mode. However, the step time data of each of the note data which constitutes the automatic performance data is not used. Instead, the sound generation timing is externally provided by the player.

Also, in the automatic performance apparatus with the concert magic function, the keyboard unit is used only for giving the sound generation timing. Therefore, the player can advance the automatic performance progress by pushing the keys of the keyboard unit to match the sound generation timing. In other words, in the automatic performance apparatus with the concert magic function, the pitch and intensity of the sound to be generated are determined based on the automatic performance data and the timing of the sound generation is determined based on the instruction of the player. In this way, various musical instrument sounds are generated.

In the conventional automatic performance apparatus, there is no room for the player intervene because a predetermined music is automatically performed when the automatic performance starting switch is operated. On the other hand, in the automatic performance apparatus with the concert magic function, the player can get satisfaction that he or she actually plays a musical instrument, because the automatic performance advances in accordance with the sound generation timing instructed by the player.

In the above-mentioned automatic performance apparatus with the concert magic function, these are various ways to stop the sound generation after the sound generation is started once. The first method is a method in which when a key is pushed, the content of the step time counter is forcedly advanced to stop the sound generation. The second method is a method in which pushing a key stops the sound generation. The third method is a method in which the sound generation is stopped when all keys are released. However, there are drawbacks with each of the above-mentioned methods.

In the first method, there is the following problem. That is, when a key is pushed, note data is read out from the automatic performance data memory and the step time data of the read-out note data is compared with the content of step time counter. When both are judged not to be coincident with each other, the step time counter is incremented. At the same time, the gate time of the sound generated at that timing (which corresponds to the content of the gate time counter) is decremented. Thereafter, until the step time data which is contained in the read-out note data and the content of the step time counter coincide, the decrement operation of the step time counter and the increment operation of the gate time counter are compulsorily repeated. The sound generation is started based on the newly read-out note data when it is judged that the step time data of the newly read-out note data coincides with the content of step time counter. Also, when the content of the gate time counter becomes zero through the repetitive operation, sound generation is stopped. In this manner, when a key is pushed and one note data is read out, the sound generation which has been started before the key is pushed is stopped and one sound corresponding to the read-out note data is generated.

In the first method, however, unless the content of the gate time counter becomes zero for the sound for which the sound generation has been started, the sound generation is never stopped. In the first method, if a key is not pushed for the next sound to start the decrement operation to the gate time counter, the gate time counter for the sound currently generated does not become zero. Therefore, there is a problem in that the sound generation continues when the operation to advance the automatic performance, i.e. the pushing operation of any key is stopped on the way of the music.

Also, there is the following problem in the second method. In the second method, that the key is pushed is detected irrespective of the contents of the step time counter and gate time counter to stop sound generation. In this case, however, if any key is not pushed for the next note data, the sound generation is not stopped, as in the first method described above. When the music is not performed until the last of music and is stopped on the way, there is a problem in that the sound generation is not stopped. Because an "end mark" exists in the end of the automatic performance data, there is caused in the above first and second methods no problem that the sound generation is not stopped where the automatic performance is performed until the end of the music.

In order to solve the above problems of the first and second methods, the third method evolved. In the third method, sound generation is stopped when all keys are released so that the operation to advance the automatic performance is stopped on the way. However, in a case where the automatic performance is done using only one key of the keyboard unit, when the key is released, it would be recognized that all keys have been released. Therefore, there is a problem in that the sound generation is stopped every time the key is released, so that the sound is intermitted and does not continue to be generated as if the music is performed in staccato.

SUMMARY OF THE INVENTION

The present invention solves the above problems of conventional automatic performance apparatus with a concert magic function.

An object of the present invention is to provide a method and apparatus for automatic performance with a concert magic function in which sound generation can be stopped without performing a piece of music in staccato in a normal performance when the operation for advancing automatic performance on the way of performance of the music is stopped.

Another object of the present invention is to provide a method and apparatus for automatic performance with a concert magic function in which whether or not sound generation is to be stopped can be selected when the operation for advancing automatic performance on the way of performance of a piece of music is stopped.

Still another object of the present invention is to provide a method and apparatus for automatic performance with a concert magic function, in which a reference time period for a step time and gate off can be changed on the way of performing a piece of music.

In order to achieve an aspect of the present invention, an automatic performance apparatus with the concert magic function includes a storage section for storing automatic performance data composed of a sequence of note data, each note data including data corresponding to gate time and data corresponding to step time, a keyboard unit which has a plurality of keys, a sound generating section for starting generation of sound corresponding to current note data of the sequence in response to a sound generating instruction, and for stopping the sound generation after a predetermined time interval equal to or longer than the gate time of the current note data corresponding to the generated sound in response to a sound generation stopping instruction, a generation instructing section for sequentially reading out the note data from the storage section in response to an operation of at least one of the keys of the keyboard unit corresponding to the sequence of note data, and for issuing the sound generating instruction to the sound generating section in accordance with the step time of the read out note data as the current note data, and a key monitoring section for detecting the number of keys of the keyboard unit which are pushed, and for issuing the sound generation stopping instruction to the sound generating section when all the keys corresponding to the sequence of note data are released.

In this case, the sound generating section preferably includes a time monitoring section for monitoring the time elapsed from the start of the sound generation for the current note data by the gate time of the current note data, and a section for stopping the sound generation in response to the sound generation stopping instruction when the time monitoring section detects the time elapsed by the gate time. Alternatively, the sound generating section may include a section for applying to the generated sound an attenuated envelope with a release time of the predetermined time interval in response to the sound generation stopping instruction to stop the sound generation. In the latter case, the sound generating section further includes a section for, stopping the sound generation of the generating sound to which the attenuated envelope is applied, when the attenuated envelope is applied to the generated sound in response to the sound generation stopping instruction, and when it is detected by the key monitoring section that at least one of the keys of the keyboard unit corresponding to the sequence of note data is pushed, in accordance with the gate time of the current note data.

An automatic performance apparatus can further include an inhibiting section for inhibiting the key monitoring section from issuing the sound generation stopping indication. The inhibiting section includes a switch element such as a pedal other than the plurality of keys of the keyboard unit.

In a case where the sound generating section starts the sound generation based on the step time of the current note data using a reference time period which is defined based on a tempo and stops the sound generation based on the gate time of the current node data, the automatic performance apparatus may further include a reference time period changing section for determining the tempo, when it is detected by the key monitoring section that at least one of the keys of the keyboard unit corresponding to the sequence of note data is pushed, in accordance with a timing when the at least one key is pushed, and for changing the reference time period based on the determined tempo. In this case, when the sound generating instruction is not issued and when the reference time period is changed by the reference time period changing section, the sound generating section further includes a section for adjusting a time interval required until the sound generation of the generated sound is stopped, to correspond to the changed reference time period. Alternatively, when the sound generating instruction is not issued and when the reference time period is changed by the reference time period changing section, the sound generating section may further include a section for, adjusting a time interval required until the sound generation of the generated sound is stopped, to correspond to the changed reference time period, and for generating sounds corresponding to the next note data and subsequent note data using the changed reference time period.

In order to achieve another aspect of the present invention, an automatic performance apparatus with a concert magic function, includes a storage section for storing automatic performance data composed of a sequence of note data, each note data including data corresponding to gate time and data corresponding to step time, a keyboard unit which has a plurality of keys, a sound generating section for starting generation of a sound corresponding to a current note data of the sequence in response to a sound generating instruction, and for stopping the sound generation while attenuating a sound volume of the generated sound over a predetermined time interval equal to or longer than the gate time of the current note data corresponding to the generated sound in response to a sound generation stopping instruction, a generation instructing section for sequentially reading out the note data from the storage section in response to operation of at least one of keys of the keyboard unit corresponding to the sequence of note data, and for issuing the sound generating instruction to the sound generating section in accordance with the step time of the read out note data as the current note data, and a key monitoring section for detecting the number of keys of the keyboard unit which are pushed, and for issuing the sound generation stopping instruction to the sound generating section when all the keys corresponding to the sequence of note data are released.

In order to achieve still another aspect of the present invention, an automatic performance apparatus includes a storage section for storing automatic performance data composed of a sequence of note data, each note data including data corresponding to gate time and data corresponding to step time, a keyboard unit which has a plurality of keys, a sound generating section for starting generation of a sound corresponding to a current note data of the sequence in response to a sound generating instruction, and for stopping the sound generation after a predetermined time interval equal to or longer than the gate time of the current note data corresponding to the generated sound in response to a sound generation stopping instruction, a generation instructing section for sequentially reading out the note data from the storage section in response operation of at least one of keys of the keyboard unit corresponding to the sequence of note data, and for issuing the sound generating instruction to the sound generating section in accordance with the step time of the read out note data as the current note data, a key monitoring section for detecting the number of keys of the keyboard unit which are pushed, and for issuing the sound generation stopping instruction to the sound generating section when all the keys corresponding to the sequence of note data are released, and an inhibiting section for inhibiting the key monitoring section from issuing the sound generation stopping instruction.

In order to achieve still another aspect of the present invention, an automatic performance apparatus with the concert magic function includes a storage section for storing automatic performance data composed of a sequence of note data, each note data including data corresponding to gate time and data corresponding to step time, a keyboard unit which has a plurality of keys, a sound generating section for starting generation of a sound corresponding to a current note data of the sequence in response to a sound generating instruction, and for stopping the sound generation after a predetermined time interval equal to or longer than the gate time of the current note data corresponding to the generated sound in response to a sound generation stopping instruction, a key monitoring section for detecting the number of keys of the keyboard unit which are pushed, and for issuing the sound generation stopping instruction to the sound generating section when all the keys corresponding to the sequence of note data are released, a reference time period setting section for, determining the tempo in accordance with a timing, when it is detected by the key monitoring section that at least one of the keys of the keyboard unit corresponding to the sequence of note data is pushed, when the at least one key is pushed, and for setting a reference time period based on the determined tempo, and a generation instructing section for reading out the current note data from the storage section when it is detected by the key monitoring section that at least one of keys of the keyboard unit corresponding to the sequence of note data is pushed, and for issuing the sound generating instruction to the sound generating section in accordance with the step time of the current note data.

In order to further another aspect of the present invention, a method of automatic performance in an automatic performance apparatus with the concert magic function includes the steps of:

detecting that all of the keys corresponding to a sequence of note data are released;

when it is detected that all of the keys corresponding to the sequence of note data are released, stopping sound generation of a currently generated sound after a predetermined time interval equal to or longer than a gate time of a note data corresponding to the currently generated sound;

detecting that at least one of the keys corresponding to the sequence of note data is pushed;

when it is detected that the at least one of the keys is pushed, reading out a next note data of the sequence from a storage section; and starting generation of a sound corresponding to the next note data of the sequence based on a step time of the next note data using a preset reference time period.

BRIEF DESCRIPTION OF THE DRAWINGS

FIG. 9 is a diagram showing the structure of note data used in the first embodiment of the present invention;

DESCRIPTION OF THE PREFERRED EMBODIMENTS

Next, the automatic performance apparatus of the present invention will be described below in detail with reference to the accompanying drawings.

Figure 1:
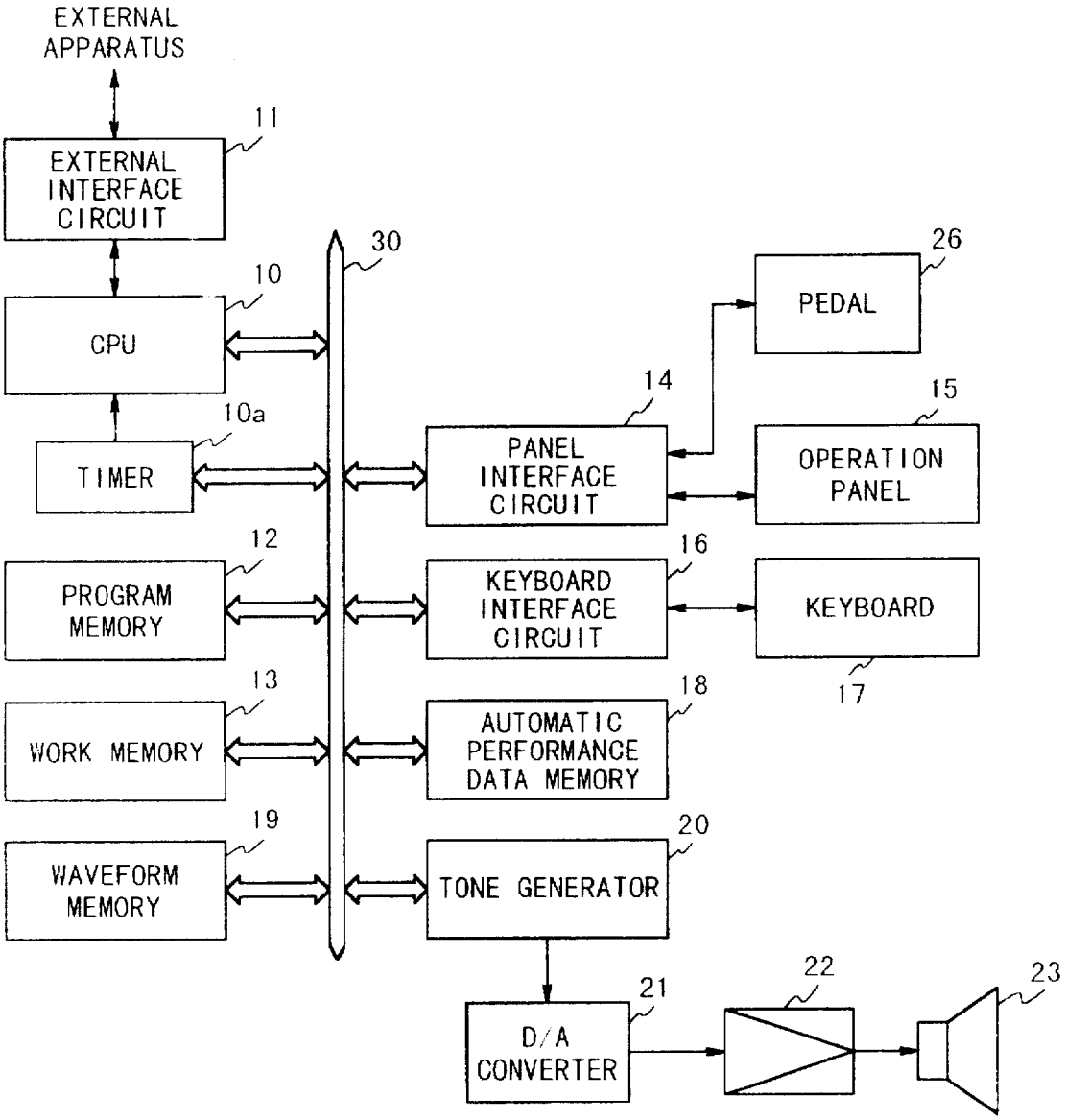
FIG. 1 is a block diagram showing the automatic performance apparatus according to a first embodiment of the present invention.

FIG. 1 is a block diagram illustrating the structure of the automatic performance apparatus according to the first embodiment of the present invention. Referring to FIG. 1, the automatic performance apparatus is mainly composed of a central processing unit (hereinafter, to be referred to as "CPU") 10, a program memory 12, a work memory 13, a panel interface circuit 14, a keyboard interface circuit 16, an automatic performance data memory 18, a wave form memory 19 and the tone generator 20. All of them are connected to each other via a system bus 30. For example, the system bus 30 is a bus line for transmitting and receiving an address signal, a data signal or a control signal.

The CPU 10 controls the automatic performance apparatus in accordance with a control program which is stored at the program memory 12. Also, a timer 10*a* is connected to the CPU 10 and the system bus 30 and an interrupt signal is generated for every constant time interval, e.g. a 2-millisecond interval. The interrupt signal generated by the timer 10*a* is supplied to the CPU 10 to initiate the timer interrupt process routine to be described later. Also, an external interface circuit 11 is connected to the CPU 10. The external interface circuit 11 is used to control transmission and receipt of data between the automatic performance apparatus and an external apparatus. For example, the external interface circuit 11 can include general-purpose interface circuits such as a MIDI interface circuit, RS232C interface circuit, SCSI interface circuit or various interface circuits having dedicated standards, in accordance with the kind of external apparatus to be connected to the external interface circuit. For example, the external apparatus, can include other electronic musical instruments, a personal computer, a sequencer and so on.

The external interface circuit 11 receives data sent from the external apparatus and the received data is supplied to the CPU 10. The CPU 10 executes the sound generating process based on this data and also changes the setting state of the operation panel 15. The data generated by operating an operation panel 15 and a keyboard unit 17 is transmitted to the external apparatus through the external interface circuit 11. In this manner, the external apparatus can be controlled through the operation of the operation panel 15 and keyboard unit 17 of the automatic performance apparatus. In the first embodiment, the MIDI interface circuit is supposed to be used as the external interface circuit 11.

The program memory 12 is composed of a read only memory (ROM). Various prefixed data which are used by the CPU 10 is stored at the program memory 12 in addition to the above-mentioned control program. A plurality of tone parameters are stored in the program memory 12. Each tone parameter is used to define a tone in a predetermined sound range of a predetermined musical instrument. Each tone parameter is composed of, for example, a wave form address, frequency data, envelope data, filter coefficients and so on. The program memory 12 can be composed of a random access memory (RAM). In this case, when the automatic performance apparatus is started, the control program, the prefixed data, the tone parameters and so on are loaded in the RAM. The work memory 13 is used to temporarily store various data used in various processes by the CPU 10. Various registers, counters, flags and the like to control the automatic performance apparatus are provided in the work memory 13. The main elements of the registers, counters and flags are described below. Other elements will be described as they appear in the description.

(1) automatic performance flag: This is a flag to store data indicative of whether or not the automatic performance apparatus is in the automatic performance mode.

(2) concert magic (CM) flag: This is a flag to store data indicative of whether or not the automatic performance apparatus is in the concert magic mode (the CM mode).

(3) address register: This is a register to hold a read address on the automatic performance data memory 18 in which the automatic performance data in an executing state is stored.

(4) key-on counter: This is a counter which counts the umber of keys which are being pushed. This counter is incremented by key pushing and decremented by key releasing.

(5) data read request flag: This is a flag which is set when the key is pushed and is used to indicate that note data should be read from the automatic performance data memory 18.

(6) simultaneous push timer counter: This is a counter set with a data indicative of a predetermined time interval and is decremented every time a timer interrupt is generated. This is used to judge whether or not more than one key is pushed within the predetermined time interval.

(7) rewind timer counter: This is a counter set with data indicative of a predetermined time interval and is decremented every time a timer interrupt is generated. This counter is used to judge whether the predetermined time interval elapses after the concert magic performance is stopped.

(8) clock counter: This is a counter which is incremented every time a timer interrupt is generated.

(9) read timing counter: This is a counter indicating whether or not processing based on the step time is delayed relate to processing based on the actual time or how much the processing based on the step time is delayed.

(10) step time counter: This is a counter which counts step time on the performance time.

An operation panel 15 and a pedal 26 are connected to the panel interface circuit 14. There are provided on the operation panel 15 various switches for controlling the automatic performance apparatus, such as an automatic performance starting switch, a concert magic (CM) setting switch, a music selection switch, a tone selector switch, an acoustic effect specifying switch, a volume adjusting switch and so on, although they are not illustrated. Also, an LED indicator which indicates the setting condition of each switch, and an LCD display for displaying a message for interaction between the automatic performance apparatus and a player are provided. The automatic performance starting switch is used for a player to control start of the automatic performance. For example, this automatic performance starting switch can be composed of a push type toggle switch. The set state of the automatic performance starting switch is stored by the above-mentioned automatic performance flag. The automatic performance flag is switched between (the automatic performance flag=0) and (the automatic performance flag=1) every time the automatic performance starting switch is pushed. When the automatic performance starting switch is pushed in a state in which the flag is "0", the flag is set to "1" and the automatic performance is started. The CM switch is used to specify whether or not the concert magic function is to be used. For example, the CM switch can also be composed of the push type toggle switch. The set state of this CM switch is stored by the above-mentioned CM flag. The CM flag is also switched between (the CM flag=0) and (the CM flag=1) each time the CM switch is pushed. When the CM switch is pushed in a state in which the flag is "0", the CM flag is set to "1".

The panel interface circuit 14 scans the respective switches on operation panel 15 in response to an instruction from CPU 10. The panel interface circuit 14 produces panel data based on the data obtained through this scan. One switch is allocated with each bit of the panel data. For example, each of the bits of the panel data shows the off state by "0" and the on state by "1". This panel data is sent to the CPU 10 through the system bus 30. The panel data is used to judge whether any switch-on or switch-off event occurs on the operation panel 15. Also, the panel interface circuit 14 sends the display data which has been sent from the CPU 10 to the LCD display on the operation panel 15. A message is displayed on the LCD display based on, for example, character data sent from the CPU 10, and the LED indicators (not shown) are lighted up or are off.

A keyboard unit 17 is connected to the keyboard interface circuit 16. The keyboard unit 17 has a plurality of keys. When any key is pushed, the keyboard unit 17 instructs generation of a sound corresponding to the key. When it is detected that the key is released, the generation of the sound corresponding to the key is stopped. On the other hand, in the CM mode, the keyboard unit 17 is used as a trigger to advance the CM mode performance. More specifically, it is a trigger for reading the next note data from the automatic performance data memory 18. As the keyboard unit 17 can be used, for example, a keyboard unit having 2-contact keys, in each of which first and second key switches are provided to be turned on at different respective press depths. In this case, a time period from when the first key switch is turned on to when the second key switch is turned on is measured and velocity data is generated based on the measured time period. The keyboard interface circuit 16 scans the respective key switches on keyboard unit 17 in response to an instruction from the CPU 10. The keyboard interface circuit 16 generates the keyboard data based on the data which has been obtained through the scanning, i.e., the data indicative of whether or not each key is pushed. The keyboard data is a sequence of bits each of which is allocated to one key. For example, each bit indicates by "1" that the key is pushed and by "0" that a hand is released from the key. In this case, a data bit of "1" may be generated to indicate that the key is pushed when both of the first and second key switches are turned on, otherwise a data bit of "0" may be generated. These keyboard data and velocity data are sent to the CPU 10 through the system bus 30. The CPU 10 judges based on the keyboard data whether or not there has been occurred a keyboard event. Note that the keyboard interface circuit 16 and the keyboard unit 17 may be substituted by the keyboard of an electronic string musical instrument, tube musical instrument, electronic percussion musical instrument, or computer. In such a case, the data which are equivalent to the keyboard data and velocity data are sent from these electronic musical instruments to the CPU 10. The CPU 10 judges the existence or non-existence of the event based on the sent data.

The automatic performance data memory 18 can be composed of ROM for example. The automatic performance data which corresponds to more than one piece of music are stored in the automatic performance data memory 18. The automatic performance data are used for normal automatic performance, concert magic performance, a combination performance, a demonstration performance and so on. Each of the automatic performance data is assigned with an identifier which is called a "song number" and a user can select a desired kind of music by specifying the song number using the music selection switch on the operation panel 15. The automatic performance data which corresponds to each of these kinds of music is composed of a sequence of note data, as in the conventional technique. Note that the automatic performance data memory 18 may be composed of a RAM, a ROM card, a RAM card, a floppy disk, or a CD-ROM. In the case where the floppy disk or CD-ROM is used as the automatic performance data memory 18, the automatic performance data is loaded in RAM and the automatic performance data stored in the RAM is accessed.

The wave form memory 19 stores the wave form data which corresponds to each of tone parameters. For example, the wave form data can be produced by performing pulse code modulation (PCM) of an electric musical instrument sound signal which corresponds to a natural musical instrument sound. The wave form memory 19 can constitute a ROM for example. The wave form data which is stored in the wave form memory 19 is read by the tone generator 20.

The tone generator 20 includes a plurality of oscillators. Although the details are not illustrated, the tone generator 20 is composed of a wave form read circuit which reads the wave form data from the wave form memory 19 and an envelope generation circuit which adds an envelope to the read out wave form data.

The CPU 10 allocates at least one oscillator to a sound generation channel when any key of the keyboard unit 17 is pushed, when note on data which instructs sound generation is received from the external interface circuit 11, or a note data is read out. A tone parameter is supplied to the allocated oscillator. The allocated oscillator receives the tone parameter and starts generation of a digital musical instrument sound signal. The oscillator sequentially reads the wave form data from the wave form memory 19, and the tone generator 20 adds an envelope to the wave form data to generate the digital musical instrument sound signal. The generated digital musical instrument sound signal is converted into an analog signal by a D/A converter 21, amplified by an amplifier 22, and sent to a speaker 23. As a result, the sound signal is converted into an acoustic signal and a sound is outputted from the speaker 23.

Next, the operation of the automatic performance apparatus according to the first embodiment of the present invention will be described with reference to flow charts shown in FIGS. 2 to 9. The operation shown in the above flow charts is realized by the processing of the CPU 10.

(1) MAIN PROCESS

Figure 2:
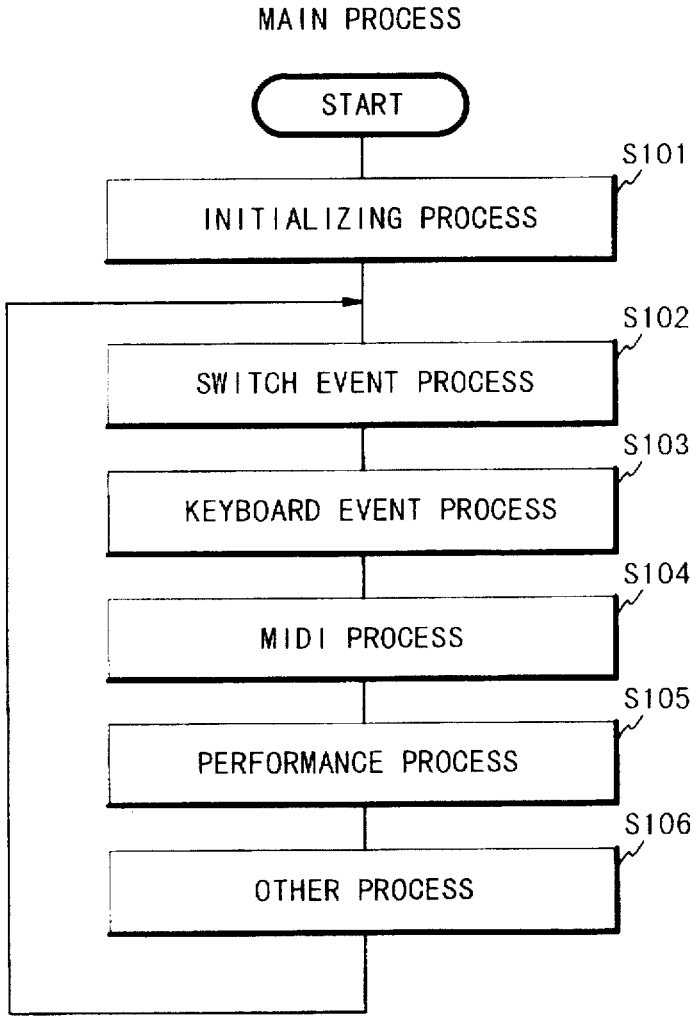
FIG. 2 is a flow chart explaining the operation of the automatic performance apparatus in a main process in the first embodiment of the present invention.

FIG. 2 is a flow chart which shows the main process routine of the automatic performance apparatus of the first embodiment. Referring to FIG. 2, the main process routine is started when the power is turned on. When the power is turned on, an initialization process is first executed (step S101). In the initialization process, the hardware inside of the CPU 10 is set to an initial state. At the same time, initial data are set to registers, counters, and flags which are defined in the work memory 13. Also, in the initialization process, a predetermined data is sent to the tone generator 20 and processing to prevent unnecessarily generated sound when the power is turned on is executed.

Next, when the initialization process ends, a switch event process is executed (step S102). That is, the CPU 10 reads out new panel data from a scan buffer provided in the work memory 13. The scan buffer is updated in a later-mentioned timer interrupt process. The read out new panel data is stored in a new panel data register which is provided in the work memory 13.

Next, the exclusive OR logic calculation of the new panel data and old panel data which has been stored in an old panel data register of the work memory 13 is calculated and a panel event map is generated. If there is not a bit of "1" in the panel event map, it is judged that the switch event does not occur. If there is a bit of "1", it is judged that the switch event occurred. For example, if the bit which corresponds to the automatic performance starting switch is "1" in the panel event map, it is judged that the event based on the automatic performance starting switch occurs, and the automatic performance flag is inverted. When the automatic performance flag is set to "1" by the inversion, a head address of the automatic performance data for the kind of music which is specified by a song number having been selected at that time, is set to the read address register. Thus, the read address of the automatic performance data is determined. Note that "the song number having been selected at that time" has been set in a song number register which is defined in the work memory 13, by operation of the music selection switch on the operation panel 15. If the bit which corresponds to the CM switch is "1" in the panel event map, in the same manner, it is judged that the CM switch event has occurred, and the CM flag is inverted. Otherwise, when it is judged that a tone selection switch event has occurred, the tone is changed from the currently set tone to a tone specified in the event. In this manner, in the switch event process, the processing to realize the functions which are allocated to the switches on the operation panel 15 is executed. Lastly, the new panel data is moved to the old panel data register and the switch event process ends.

Next, in the main process routine, a keyboard event process is executed (step S103). That is, the CPU 10 reads out new keyboard data from the keyboard interface circuit 16 and stores in a new keyboard data register which could be provided in the work memory 13. Next, the exclusive OR logic calculation of the new keyboard data and an old keyboard data which is already stored in an old keyboard data register of the work memory 13 is calculated and the keyboard event map is generated. If there is any bit of "1" in the keyboard event map, a keyboard event which corresponds to the bit is judged to have been generated. If there is no bit of "1", the keyboard event is judged not to have been generated. Next, whether or not the keyboard event is a key push event or a key release event is determined. This is performed by checking the bit in the new keyboard data which corresponds to the bit which is set to "1" in the keyboard event map. That is, the key push event is judged to have been generated when the corresponding bit is "1" in the new keyboard data and a key push event process is executed. On the other hand, the key release event is judged to have been generated when the corresponding bit is "0", and a key release event process is executed. The details of the key push event process and key release event process will be described later.

Next, a MIDI process is performed (step S104). In the MIDI process, the start of the sound generation and stop of the sound generation are performed based on an MIDI data which is received from the external interface circuit 11. Because the MIDI process itself is not directly related to the present invention, the explanation is omitted.

Next, the performance process is performed (step S105). In the performance process, the concert magic performance process, the automatic performance process and a combination performance process of them and so on are performed. These details will be described later.

Next, the other process is executed (step S106). In the other process, processes other than the above-mentioned processes are performed such as a process which needs a regular check in the main process routine and a process for realizing a special operation when a switch is continued to be pushed. Thereafter, the control returns to the step S102 and the processes from the step S102 to the step S106 are repeated. When the switch event or the keyboard event is generated during the repetitive execution of the above-steps S102 to S106, or when an event that data is received from the external interface circuit 11 is generated, the process corresponding to the generated event is executed or the sound generation process is executed based on the automatic performance data. In this manner, the various functions of the automatic performance apparatus are realized.

(2) TIMER INTERRUPT PROCESS

Figure 3:
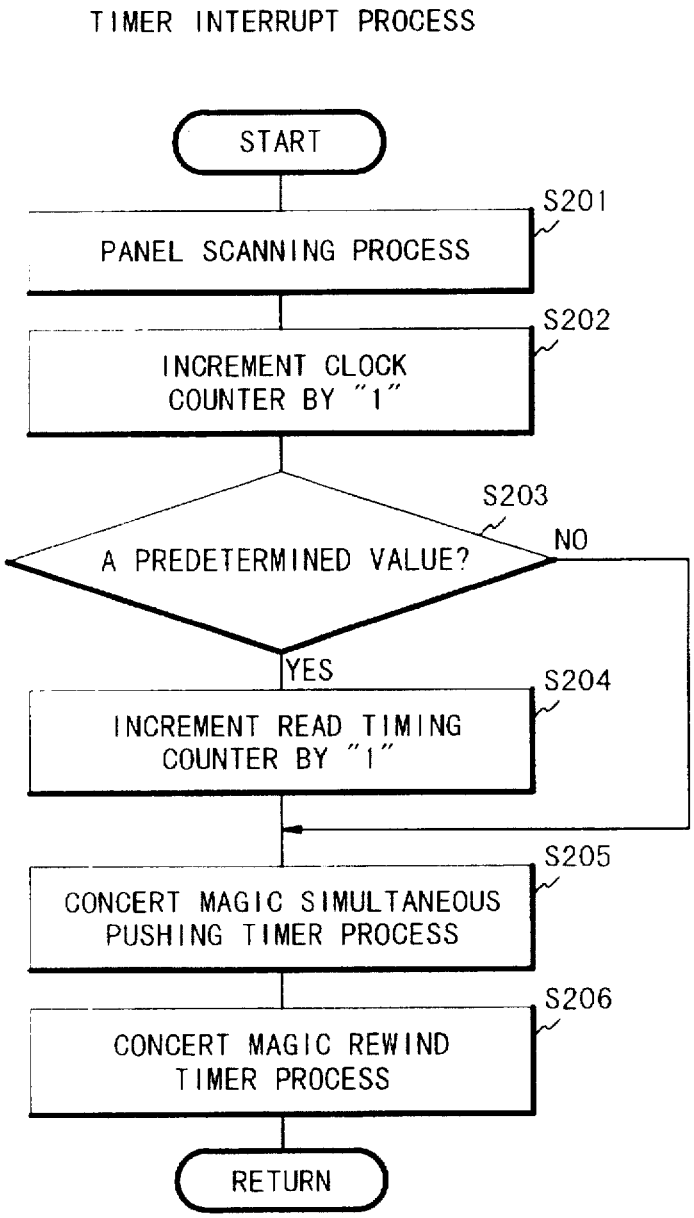
FIG. 3 is a flow chart explaining the operation of the automatic performance apparatus in a timer interrupt process in the first embodiment of the present invention.

A predetermined time period is set in the timer **10*a* by the CPU 10 and an interrupt signal is generated every predetermined time period. The CPU 10** interrupts an executing process of the above main process routine in response to the interrupt signal to execute the timer interrupt process. The detail of the timer interrupt process is shown in a flow chart of FIG. 3. Referring to FIG. 3, in the timer interrupt process, the panel scanning process is first performed (step S201). That is, the CPU 10 reads out panel data from the panel interface circuit 14 and stores the data in a scan buffer which is provided in the work memory 13 in order. For example, the scan buffer may be constituted to operate as a FIFO memory under the control of the CPU 10. Instead of constituting the FIFO memory in the work memory 13, the scan buffer may be composed of a FIFO element.

Next, the clock counter is incremented (step S202). In this way, the clock counter is incremented by "1", for example, every 2 milliseconds. Next, whether or not the content of the clock counter reaches a predetermined value is determined (step S203). Here, the predetermined value means the value which is equivalent to the 1 step time of the tempo which has been set at that time. When it is judged that the content of the clock counter reaches the predetermined value, the read timing counter is incremented by "1" (step S204). The process of step S203 is skipped when it is judged in the above step S203 that the content of the clock counter has not yet reached the predetermined value.

Next, the concert magic simultaneous push timer process is executed (step S205). In this process, the simultaneous push timer counter is decremented by "1". Then, the concert magic rewind timer process is executed (step S206). In this process, the rewind timer counter is decremented by "1". Thus, a monitored period of time from now to initialization of the read address is reduced.

After that, the control returns from the timer interrupt process routine to the main process routine at the position where the timer interrupt has been generated, as in the normal interrupt processing well known in the art. The panel scanning is performed in the timer interrupt process in the first embodiment. It may be performed in the switch event process (step S102) of the main process routine (FIG. 2).

(3) KEY PUSH EVENT PROCESS

Figure 4:
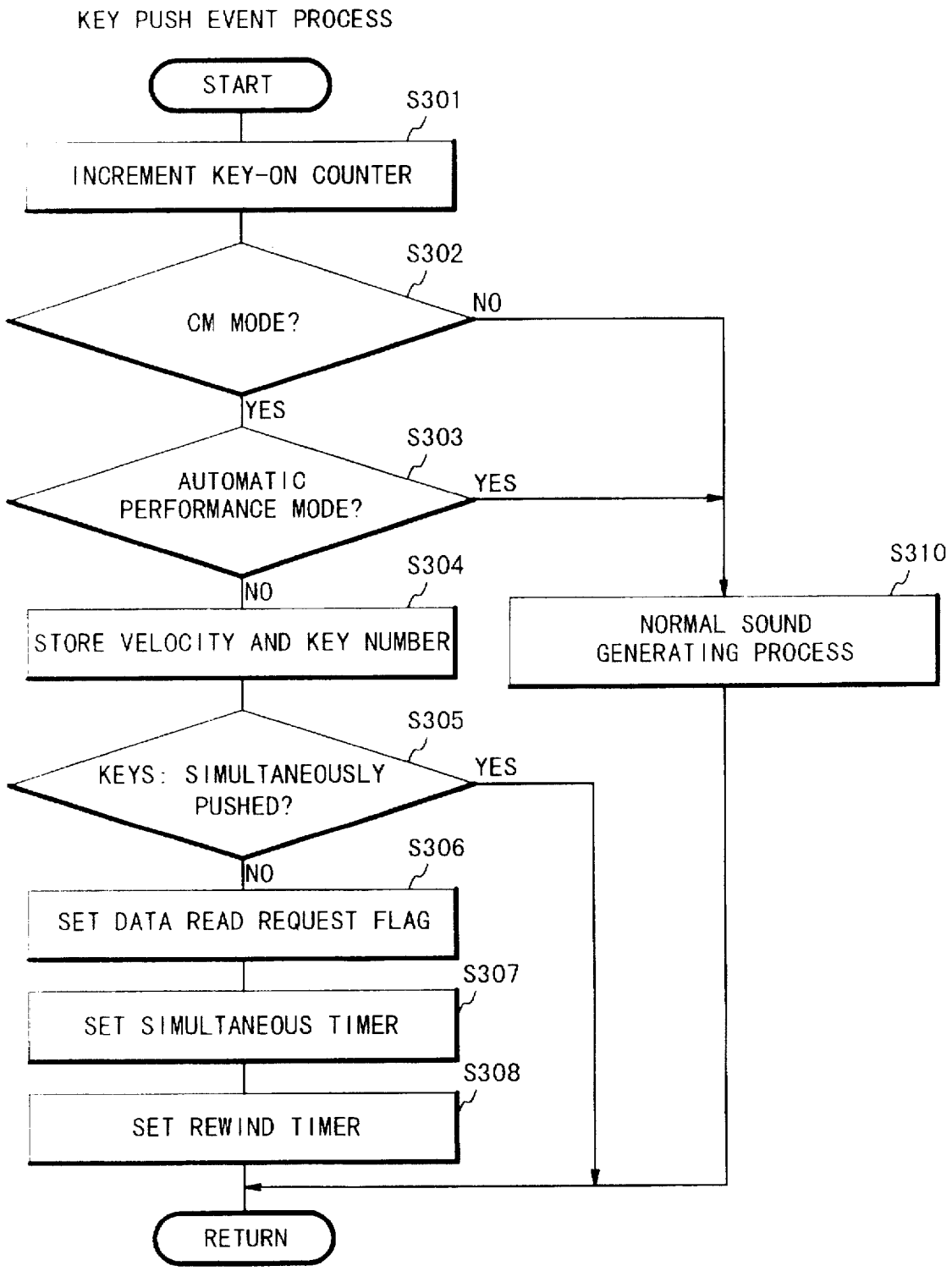
FIG. 4 is a flow chart explaining the operation of the automatic performance apparatus in a key push event process in the first embodiment of the present invention.

FIG. 4 is a flow chart which shows the detail of the key push event process. Referring to FIG. 4, in the key push event process, the key-on counter is first incremented (step S301). The key-on counter is used to count the number of the keys which are pushed at present, as described above. The key-on counter is incremented when there is generated a key push event and is decremented when there is generated a key release event. Therefore, when the content of the key-on counter is zero, it means that all the keys are released.

Next, whether or not the concert magic (CM) mode is set is determined (step S302). This determination is performed by checking the CM flag. When it is judged that the CM mode is not set, a normal sound generation process is executed in accordance with the key having been pushed (step S310). In the normal sound generation process, a key number of the key which corresponds to the bit set to "1" in the keyboard event map is detected as described above. At the same time, velocity data which corresponds to the key is read from the keyboard interface circuit 16. Also, note data which corresponds to the detected key number is read from the automatic performance data memory 18. The note data has the structure shown in FIG. 9. Further, an oscillator is allocated for the note data in tone generator 20. The tone parameter which corresponds to the detected key number is read from the program memory 12 and is sent to the tone generator 20 together with the velocity data. The tone generator 20 reads out wave form data which corresponds to the tone parameter from the wave form data memory 19 and starts the sound generation for the key which has been pushed, using envelope data of the tone parameter. The generated sound is output from the speaker 23 with intensity determined in accordance with the velocity data.

Next, when it is judged in the above step S302 that the CM mode is set, whether or not the automatic performance mode is set is determined (step S303). This determination is performed by checking the automatic performance flag. When it is judged that the automatic performance mode is set, the control branches to a step S310 where the normal sound generation process is executed (step S310). As a result, the sound is generated in response to the timing of the key operation if the automatic performance mode is set and the CM mode is also set. Therefore, a player can perform melody performance depending on the keyboard unit 17 to the background of the automatic performance along with normal sound generation stopping process (step S404) in a key release event process which will be explained below.

On the other hand, when it is judged in the step S303 that the automatic performance mode is not set, the process for realizing the concert magic function is hereinafter performed. That is, the velocity data and the key number are first stored (step S304). More particularly, the key number of the key which corresponds to the bit of "1" in the keyboard event map is detected. At the same time, the velocity data which corresponds to the key is read from the keyboard interface circuit 16 and is stored in a predetermined buffer area of the work memory 13. The stored key number is used to judge whether or not in response to the pushed key the sound generation process is to be executed or the automatic performance is to be advanced in a concert magic main process to be described later, in a case where the automatic performance apparatus is operated in a split mode. Also, the velocity data is used to control the sound volume in the concert magic main process to be described later.

Next, whether or not two ore more keys are pushed at the same time is determined (step S305). This determination is performed by checking whether an elapsed time interval from when a key is pushed in the last time to when a key is pushed in this time is about 30 milliseconds, for example. More particularly, it is performed by checking whether or not the content of the simultaneous push timer counter which has been set in the key push event process in the last time has become zero. When it is judged that more than one key is pushed at the same time, the key push event process is not executed and the control returns from the key push event process routine to the main process routine. If the predetermined time interval does not elapse during a time period from when a key has been pushed to when the next key is pushed in the way, the pushing operation of the next key is ignored. As a result, even if two or more keys are erroneously pushed at the same time, it is possible to prevent the automatic performance from being erroneously advanced.

On the other hand, when two or more keys are judged not to have been pushed at the same time, a data read request flag is first set (step S306). The data read request flag is referred to in the performance process to be described later. Next, the predetermined time interval data is set in the simultaneous push timer counter (step S307). The predetermined time interval data such as about 30 milliseconds, for example, is used to measure the time interval, as described above. Next, predetermined time interval data is set in the rewind timer counter (step S308). As the predetermined time interval data, a time interval of, for example, one minute is used. The rewind timer counter is used to reset the content of the address register to the head address of the automatic performance data of the music currently performed when the performance does not progress regardless that the predetermined time interval has elapsed. After that, the control returns from the key push event process routine to the main process routine.

(4) KEY RELEASE EVENT PROCESS

Figure 5:
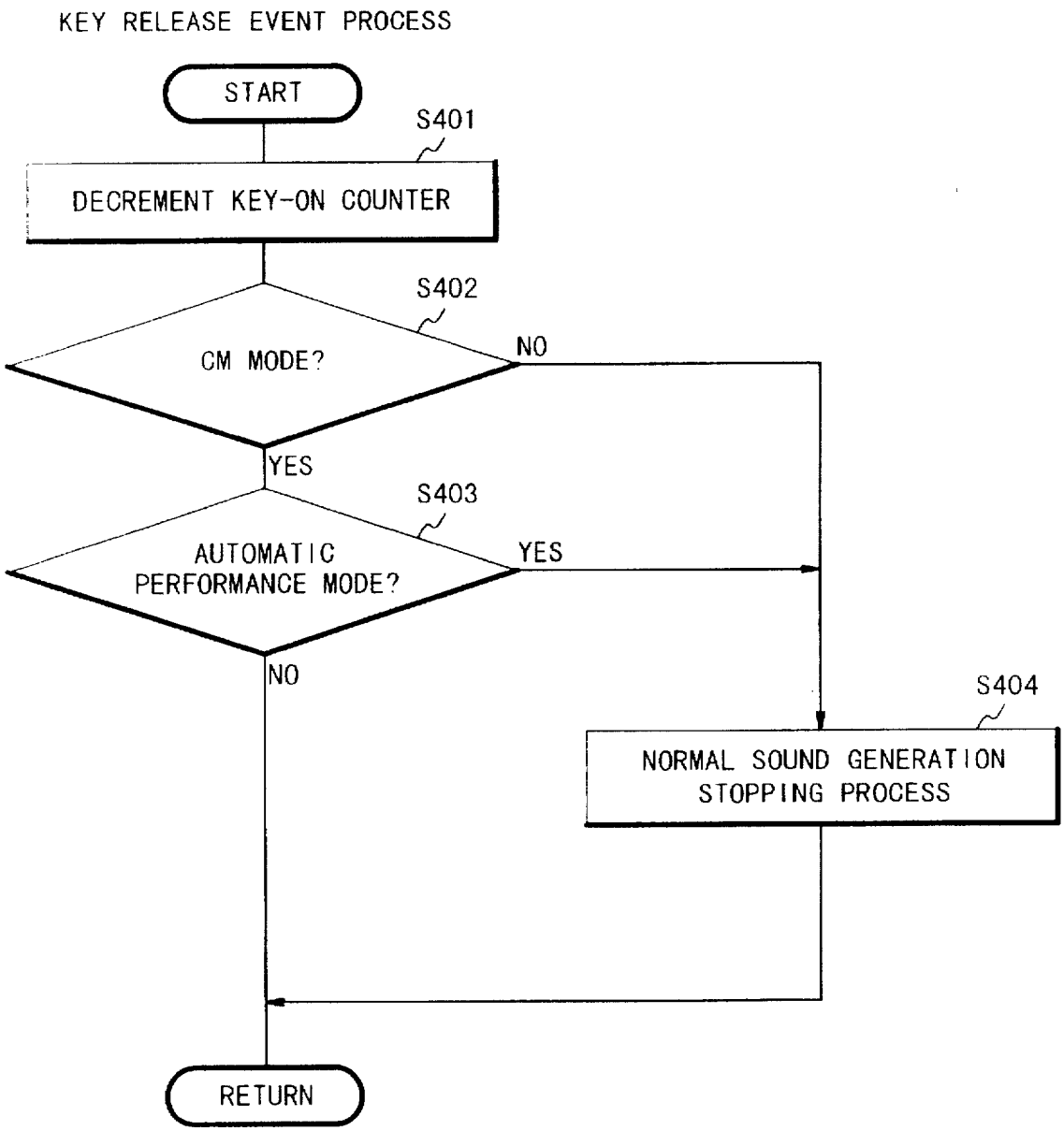
FIG. 5 is a flow chart explaining the operation of the automatic performance apparatus in a key release event process in the first embodiment of the present invention.

FIG. 5 is a flow chart which shows details of the key release event process. Referring to FIG. 5, in the key release event process, the key-on counter is first decremented (step S401). Next, whether or not the concert magic (CM) mode is set is checked (step S402). When it is judged that the CM mode is not set, a normal sound generation stopping process is executed (step S404). In the sound generation stopping process, the key number of the key which corresponds to a bit set to "1" in the keyboard event map is detected. A quickly attenuating envelope data is applied to the oscillator corresponding to the key number in the sound generation. Thereby, the sound generation is stopped in response to the releasing operation of the key. Next, when it is judged in the above step S402 that the CM mode is set, whether or not the automatic performance mode is set is determined (step S403). This is performed by checking the automatic performance flag. When it is judged that the automatic performance mode is set, the control branches to step S404 so that the normal sound generation stopping process is executed. The stop of the sound generation is accomplished in response to the key release event if the CM mode is set and the automatic performance mode is also set. Therefore, the automatic performance apparatus can play melody performance depending on the keyboard unit 17 to the background in the automatic performance along with the normal sound generation process (step S310) in the key push event process.

On the other hand, when it is judged in step S403 that the automatic performance mode is not set, the control returns from the key release event process routine to the main process routine. In a case where all the keys are released in the concert magic mode, the sound generation is stopped in accordance with the gate time data of the note data which corresponds to the sound currently generated. The process for stopping the sound generation is executed in the concert magic performance process to be described later. On the other hand, if all the keys are not released even if there is generated the key release event, no processing is executed as for the key release event.

(5) PERFORMANCE PROCESS

Figure 6:
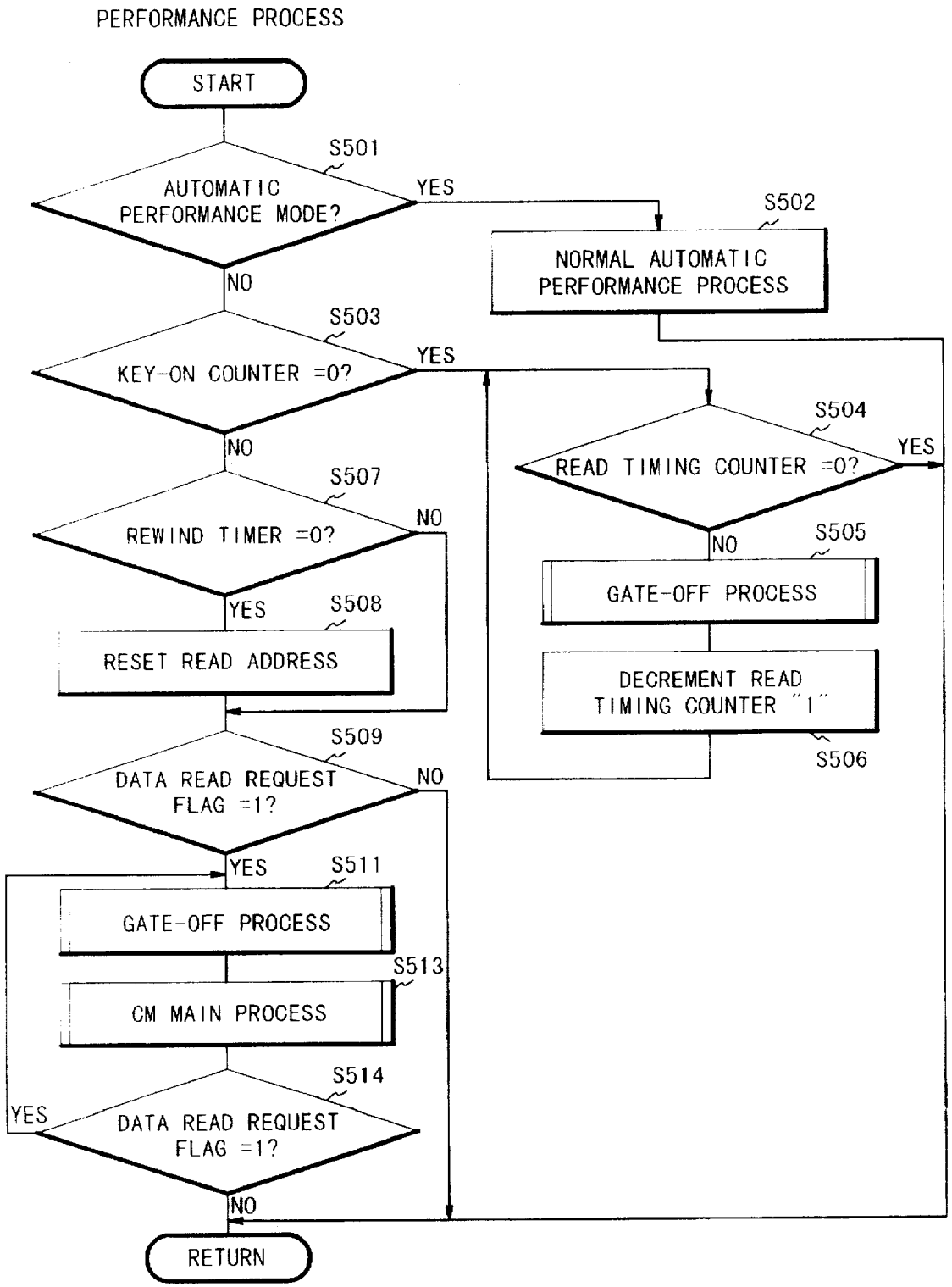
FIG. 6 is a flow chart explaining the operation of the automatic performance apparatus in a performance process in the first embodiment of the present invention.

Next, the detail of the performance process which is performed in step S105 of the main process routine will be described with reference to the flow chart of FIG. 6. In the performance process, the concert magic performance process, the automatic performance process, and a combination of them are performed.

Whether or not the automatic performance mode is set is first determined (step S501). This determination is executed by referring to the automatic performance flag. When it is judged that the automatic performance mode is set, the automatic performance process is executed (step S502). In the automatic performance process, step time data corresponding to the note data and the content of the step time counter are compared to each other. It is judged that the sound generation timing is reached when both of these data coincide, and the note data is read out from the automatic performance data memory 18. The sound generation is started based on the note data. Thus, the automatic performance is executed in accordance with a predetermined tempo based on original sound generation timing of the automatic performance data depending upon a step time data. Because the normal automatic performance process are well-known, the detailed explanation is omitted.

When it is judged in the above step S501 that the automatic performance mode is not set, the concert magic performance process is executed. That is, whether or not the content of the key-on counter is zero is first checked (step S503). When it is judged that the content of the key-on counter is zero, i.e., when it is judged that all keys are released, the sound generation stopping process is executed in accordance with the gate time of the note data for the sound currently generated. Whether or not the content of the read timing counter is zero is first checked (step S504). Whether the timing of the sound generation or the timing of the sound generation stop is delayed because of other processing, and whether or not the timing of the sound generation or the sound generation stop is reached are determined. When it is judged that the content of the read timing counter is not zero, i.e. that the timing is not delayed, the control returns from the concert magic performance process routine to the main process routine without performing any process. The fact that the content of the read timing counter is zero means that the control does not yet reach the timing of the sound generation stop. Since the time period for the one step time does not elapse from the sound generation timing in the last time, the control does not reach the timing when the gate time is decremented. The performance process routine is executed in the main process routine and the step S504 is executed each time the concert magic performance process is executed. In parallel, in above-mentioned timer interrupt process routine, the content of the read timing counter is incremented when the time period for the one step time elapses from the sound generation timing in the last time. Therefore, it is judged in the step S504 that the content of the read timing counter is not zero when the time period for the one step time elapses from the sound generation timing in the last time. When it is judged in the step S504 that the content of the read timing counter is not zero, the gate-off process is executed (step S505). The gate-off process is the process for decrementing the gate time of the note data corresponding to the sound to be generated.

Figure 8:
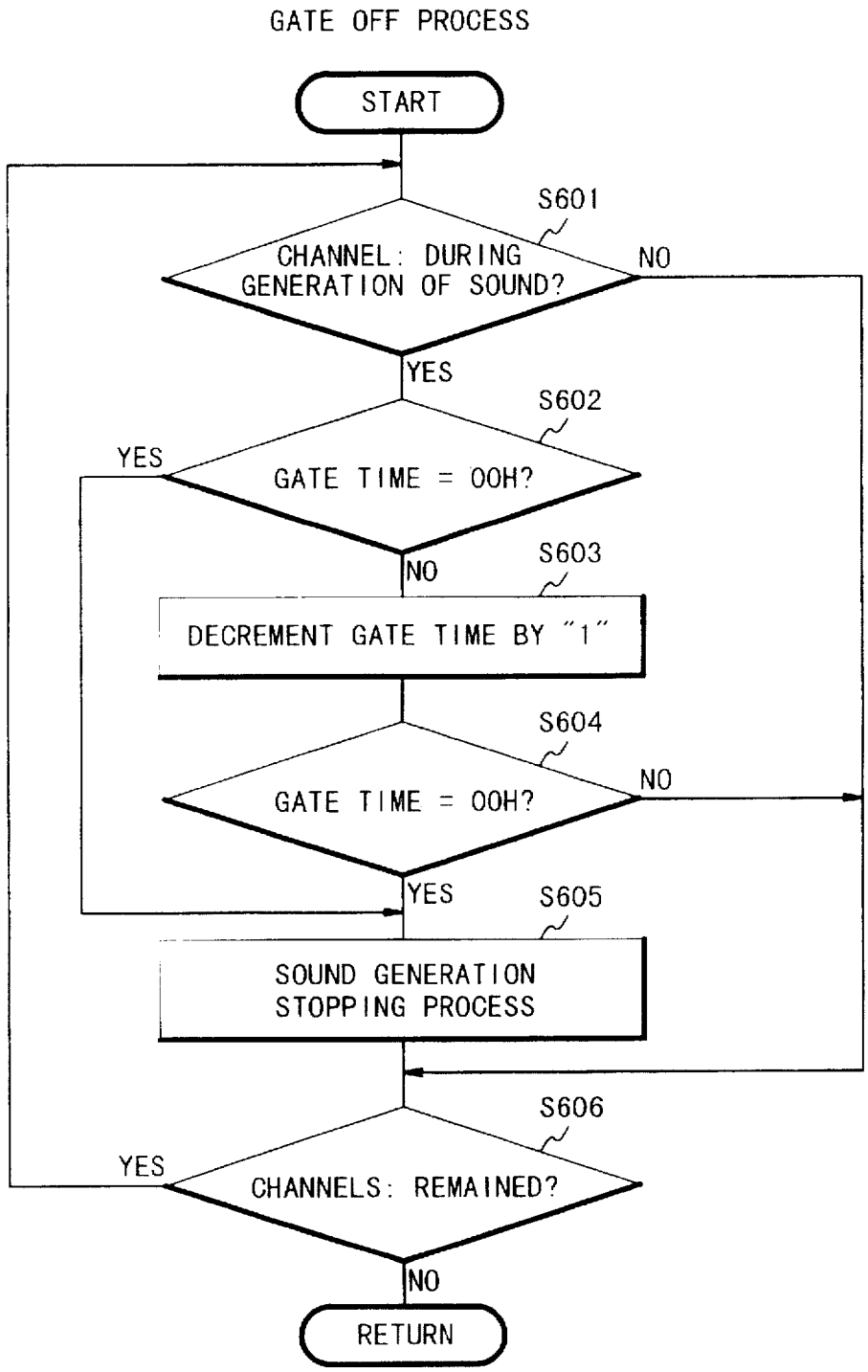
FIG. 8 is a flow chart explaining the operation of the automatic performance apparatus in a gate-off process in the first embodiment of the present invention.

The detail of the off-gate process is shown in the flow chart of FIG. 8. Referring to FIG. 8, in the gate-off process, whether or not a channel assigned for the sound generation is on the sound generation is determined. The gate time is decremented if there is a channel which is during the sound generation. That is, whether or not the channel is on the sound generation is determined (step S601). When it is judged that the channel is not on the sound generation, the control branches to a step S606 to determine whether or not there is any channel which is not yet processed. When it is judged that there is no un-processed channel, the control returns from the gate-off process routine.

On the other hand, when it is judged in the step S606 that there is any un-processed channel, step S601 is again executed. Next, when it is judged in the step S601 that the channel is on the sound generation, whether or not the gate time of the channel is "00H" ("H" of the end is the hexadecimal notation and the same below) is determined (step S602). When it is judged that the gate time is "00H", the control branches to a step S605 to execute the sound generation stopping process for the channel. The sound generation stopping process is executed in the same manner as the sound generation stopping process in the step S404 of the above-mentioned key release event process of FIG. 5.

On the other hand, when it is judged that the gate time is "00H", the gate time of the channel is decremented (step S603). Then, whether or not the gate time is "00H" is determined (step S604). When it is judged that the gate time is "00H", the control advances to a step S605 and the sound generation stopping process is executed (step S605).

On the other hand, when it is judged that the gate time is not "00H", the control branches to a step S606 to execute the same process as described above. In this manner, in the gate-off process, the channel which is on the sound generation is detected from among the channels which are allocated to the sound generation and the gate time of the note data which corresponds to the channel is decreased. As a result, when the gate time is zero, the sound generation stopping process is executed. Since the gate-off process routine is called when the control reaches the sound generation timing, the function that the gate time is decremented every step time is realized.

The description goes back to the concert magic performance process. Referring to FIG. 6 again, when the gate-off process is ended (step S505), the content of the read timing counter is decremented (step S506). After that, the control returns to the step S504 and the same processes are repeated. Note that although the content of the read timing counter generally becomes only "+1", the steps S505 and S506 are repeated more than one time in a case where another process takes a great deal of time and the content of the read timing counter become "+2" or above. Thus, the time period necessary to make the gate time zero is controlled such that it is specified by the gate time data. In this manner, in a case where all the keys are released the currently generated sound is generated only during the time period corresponding to the gate time of the note data for the sound, and then the sound generation is stopped by the process of steps S503 to step S506. Even if all the keys are released, the sound to be currently generated is not immediately extinguished at the time when all the keys are released. Therefore, the problem of that the being intermittent as is the case when the performance is executed in the staccato in the conventional automatic performance apparatus, so that smooth performance cannot be executed, is resolved.

When it is judged that in the above step S503 the content of the key-on counter is not zero, the sound generation process is executed based on the concert magic function. Whether or not the rewind timer is zero is first determined (step S507). When the rewind timer is zero, the read address (the content of the address register) for the automatic performance data is reset (step S508). The head address of the automatic performance data for the music which has been selected at the point is set in the address register as the read address. Thereby, the function that the concert magic performance is started from the head of the music is realized in a case where the keyboard is operated next when there is not keyboard operation even if the predetermined time, e.g., one minute, elapses. If the rewind timer is not zero in the above step S507, the step S508 is skipped.

Next, whether or not the data read request flag is "1" is determined (step S509). Whether or not the key is pushed is determined. It is recognized that the key is not pushed when the data read request flag is "0", and the control returns from the performance process routine to the main process routine without performing any process. On the other hand, when in the above step S509 that the data read request flag is "1", that the key has been pushed and the sound generation process for the concert magic performance is hereinafter the executed. That is, the gate-off process is executed (step S511). The process is the same as the process which is executed with the above mentioned step S505. The gate time of the sound to be currently generated is decremented.

Next, the concert magic main process is executed (step S513). The concert magic main process is the process which one note data is read out from the automatic performance data memory 18 and the sound generation process is executed based on the read out note data. Here, the detail of the concert magic main process will be described with reference to the flow chart of FIG. 7.

Figure 7:
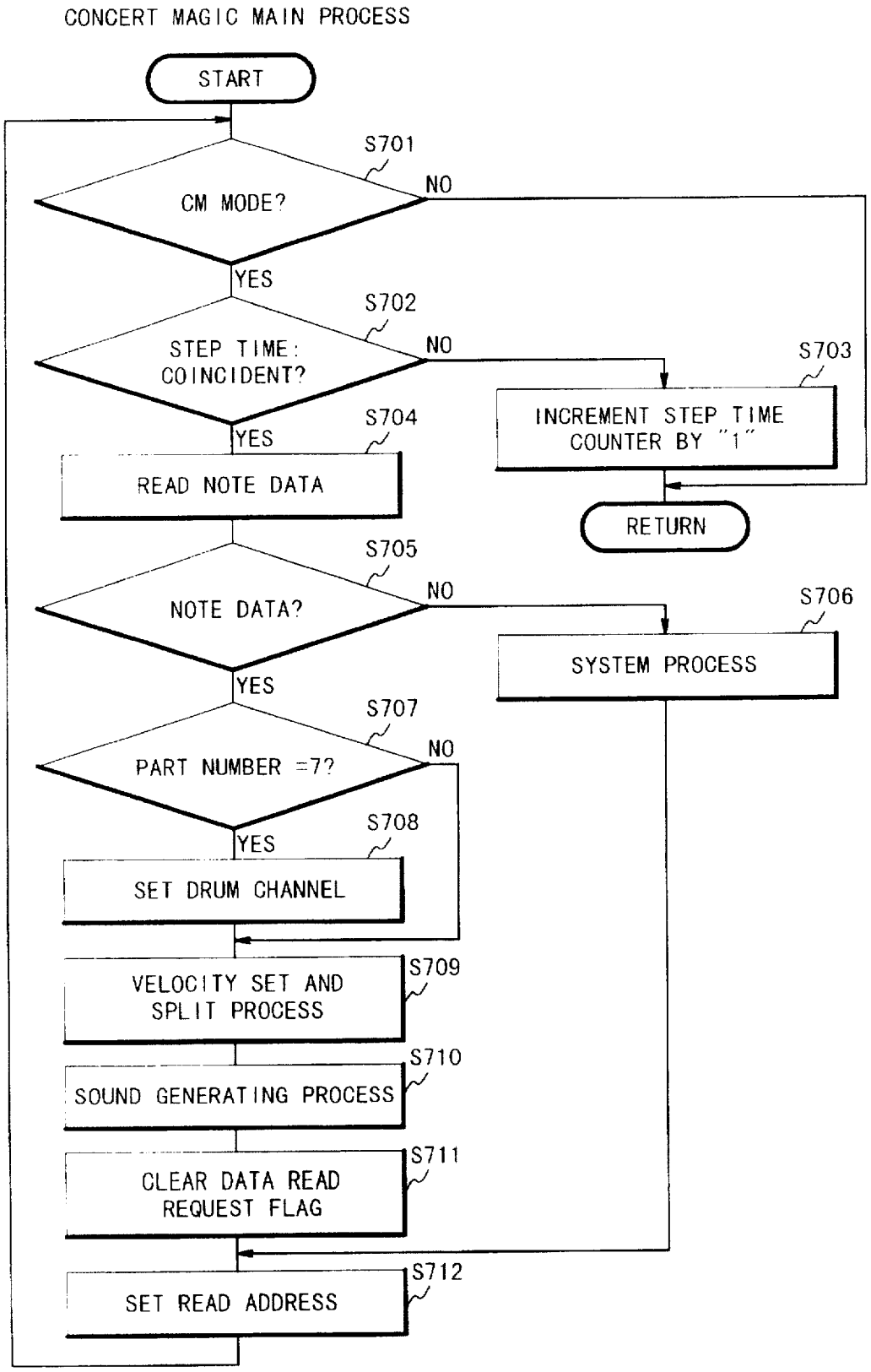
FIG. 7 is a flow chart explaining the operation of the automatic performance apparatus in a concert magic main process in the first embodiment of the present invention.

Referring to FIG. 7, in the concert magic main process, whether or not the CM mode is set is first determined (step S701). The determination is executed by checking the CM flag. When it is judged that the CM mode is not set, the control returns from the concert magic main process routine to the performance process routine. In other words, in the case of not being the CM mode, the sound generation process is not executed based on the automatic performance data even if the key is pushed. Next, when it is judged in the above step S701 that the CM mode is set, whether both the step times are coincident i.e., whether or not the step time of the note data which is specified by the read address which is set in the address register is coincident with the content of the step time counter is determined (step S702). When it is judged that both are not coincident, the content of the step time counter is incremented (step S703). After that, the control returns from the concert magic main process routine to the performance process routine.

In the performance process routine, whether or not the data read request flag is "1" is determined (step S514). Since the data read request flag is not reset in this case, the flag remains "1". If at "1", the control returns to step S511 and the same process is repeated. The content of the step time counter is incremented by the repetitive execution of above steps (step S511→S513→S701→S702→S703→S514→S511→ . . .). At the same time, the gate time of the sound to be currently generated is decremented. Note that the above-mentioned repetitive execution is executed at the process speed of the CPU 10 irrespective of the checking timing or the sound generation timing.

When the step time of the note data which is specified by the read address which is set in the address register with step S702 is coincident with the content of the step time counter, the read operation of the note data for a sound to be generated next is executed (step S704). Next, whether or not the read out data is the note data is determined (step S705). For example, the determination is executed by checking an MSB of the first byte (the key number) of the note data. A system process is executed (step S706) when the read out data is not the note data. In the system process, the processes such as and the tone change, the effect change are executed. In this case, because the control returns to the performance process without resetting the data read request flag, step S511 is executed.

Next, when it is judged in the step S705 that the read out data is the note data, whether or not a part number is "7" is determined (step S707). For example, the determination is executed by referring to lower 3 bits of the fourth byte of the note data. Here, the part number "7" is the part which is allocated to the drum channel. When the part number is "7", the dram channel set process is executed (step S708). The process is the process for changing the part number "7" into "10" to adjust the part number of the note data to the part number of the drum channel which is defined in the tone generator 20. When it is judged in the above step S707 that the part number is not "7", the step 708 is skipped. Next, velocity setting and split processes are executed (step S709). In the velocity set process, the velocity which is stored in the predetermined buffer area of the work memory 13 in step S304 of the key push event process routine is sent to the tone generator 20. Also, in the split process, whether or not the key number of the key which has been pushed belongs to a key area for the normal performance or to the key area for the concert magic is determined based on the key data which is stored similarly. When the pushed key belongs to the key area for the concert magic, the tone parameter which corresponded to the note data is sent to the tone generator 20 to perform the sound generation which is based on the note data. On the other hand, when the key number of the pushed key belongs to the key area for the normal performance, the sound generation process is not executed.

Next, the sound generation process is started based on the tone parameter and velocity data which are set in step S709 (step S710). The content of the sound generation process is the same as the content which is executed in step S310 of the key push event process. Next, the data read request flag is cleared (step S711). The read address of the following note data is then set in the address register (step S712). Thereafter, the control returns to the step S701 and the same process is repeated to other note data which results in the sound generation timing. Therefore, if more than one note data having the same step time exists, the sounds for all of them are generated at the same time.

In the automatic performance apparatus of the present invention, the note data that includes the gate time data defining the sound length is read out each time it is detected that the key is pushed, and the sound generation is started based on the read out note data and the sound to be currently generated is extinguished. Therefore, in the case where no key is pushed, the sound to be currently generated is extinguished when it is detected that a time period corresponding to the gate time of the note data for the generated sound has elapse.

In the above embodiment, although the automatic performance apparatus operates such that the automatic performance is advanced by pushing either key of the keyboard unit 17, it may be is advanced with a foot switch or a predetermined switch on the operation panel 15 without being limited to the key.

Next, the automatic performance apparatus according to the second embodiment of the present invention will be described. The hardware structure of the automatic performance apparatus in the second embodiment is the same as the hardware structure of the automatic performance apparatus in the first embodiment, but differs from the first embodiment in the key release event process and the concert magic performance process. Therefore, only the different points will be described below.

(6) KEY RELEASE EVENT PROCESS

Figure 10:
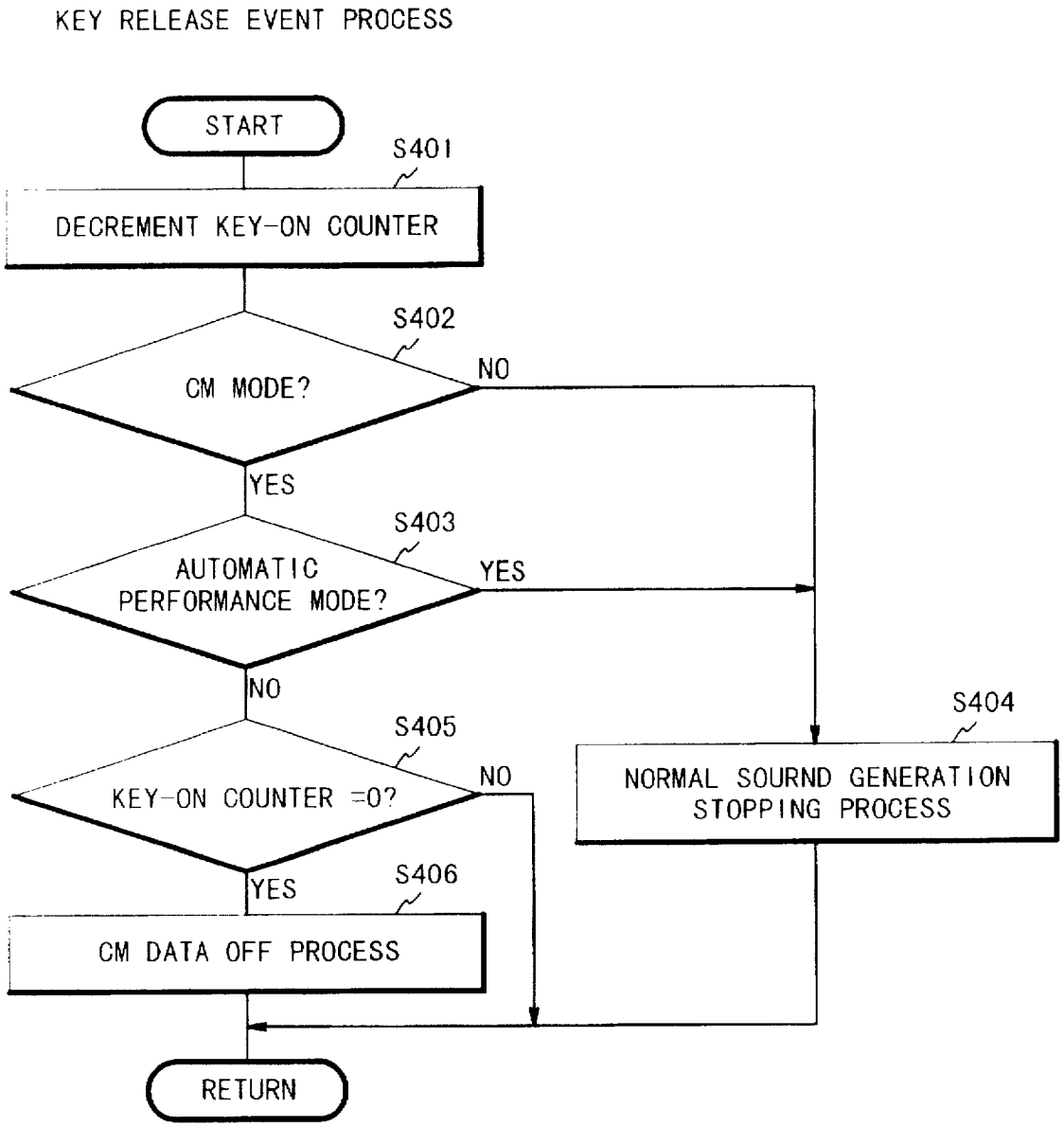
FIG. 10 is a flow chart explaining the operation of the automatic performance apparatus in the key release event process in a second embodiment of the present invention.

FIG. 10 is the flow chart which shows the detail of the key release event process in the second embodiment. Referring to FIG. 10, the processes from step S401 to step S404 are the same as those of the key release event process in the first embodiment.

Whether or not the automatic performance mode is set is determined in a step S403. The determination is executed by checking the automatic performance flag. When the automatic performance mode is set, the control branches to the step S404 and the normal sound generation stopping process is executed. On the other hand, when in step S403 that the automatic performance mode is not set, whether or not the content of the key-on counter is zero is determined (step S405). When the key-on counter is not zero, it is one or more keys are pushed. In the case, because the sound generation of the sound to be currently generated is stopped by pushing of a next key, the control returns from the key release event process routine to the main process routine without performing any process. That is, in response to the pushing of a next key, the sound generation of a sound is generated based on a new note and the sound generation currently operating is stopped if all the keys are not released (if at least one key is pushed) even if there is generated a key release event.

When it is judged in the step S405 that the content of the key-on counter is zero, it is recognized that all the keys are released, and a CM data off process is executed (step S406). In the CM data off process, when the sound currently generated must have a long endurance time, a process is executed in which the sound having the envelope of the long endurance time is changed into a sound having the attenuated envelope of a long release time. For example, whether or not the sound currently generated is of the long endurance time can be judged based on the tone number which is set at the time point in a tone number register which is provided in the work memory 13. Note that the content of the tone number register is changed by a tone selector switch of the operation panel 15 or a tone change data which is contained in the automatic performance data, for example.

By the above-mentioned process, when all the keys are released, the situation that the sound generation is immediately stopped and that the sound becomes intermittent on the way of performance can be avoided, unlike the conventional automatic performance apparatus. At that time, the gate time of the sound currently generated is maintained to the original value. The gate time is decremented when the step time is incremented in a case where the next pushing of a key is performed so that the sound generation is performed based on a new note data. When the gate time becomes zero by the decrement of the gate time, the sound attenuated but endured is extinguished. In this case, the sound generation is actually stopped on the note data and the sound generation is stopped, because the gate time is decreased and becomes zero.

(7) PERFORMANCE PROCESS

Figure 11:
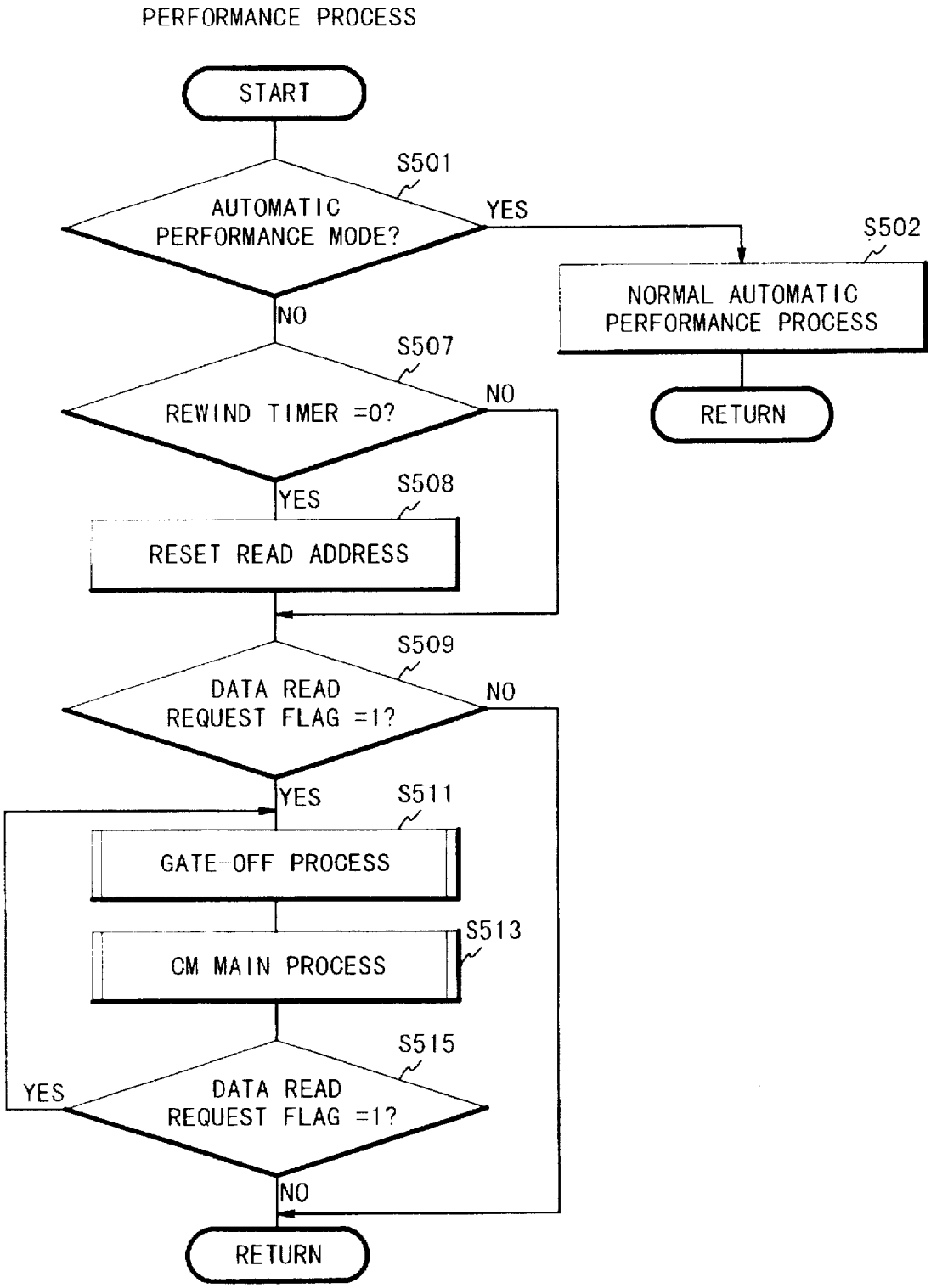
FIG. 11 is a flow chart explaining the operation of the automatic performance apparatus in performance process in the second embodiment of the present invention.

Next, the differences between the second embodiment and the first embodiment will be described with reference to the flow chart of FIG. 11. As seen from FIG. 6, the processes from step S503 to the step S506 are deleted from the flow chart of FIG. 6. This is because it is not necessary to execute the sound generation stopping process since the stop of sound generation is performed in the key release event process. However, it would be apparent that the processes of the steps S405 and S406 of FIG. 10 may be inserted between the steps S501 and S507 of FIG. 11.

According to the automatic performance apparatus of the present invention, in a case where it is detected that the key release event is generated and it is detected that all the keys are released (i.e., there is no key currently pushed), the envelope of the sound currently generated is changed from the envelope corresponding to long endurance time into the attenuated envelope corresponding to long release time. The change of the envelope can be realized by setting the parameter which defines the attenuated envelope with the long release time in the tone generator. The release time is a predetermined time period longer than the gate time, e.g., twice the gate time. In this manner, since the sound currently generated is gradually attenuated and extinguished after a predetermined time, there is no case that the sound continues to be generated even if the player stops the operation for advancing of the automatic performance (e.g., pushing a key) on the way. Also, because the sound continues to be generated while attenuating even if all the keys are released, the automatic performance can be smoothly accomplished without intermitting the sound. If the sound currently generated is the attenuated sound when all the keys are released, it would be not necessary to change the envelope.

Also, according to the automatic performance apparatus of the present invention, because the next key is not yet pushed at the timing when the envelope is changed, the gate time of the sound attenuated but endured is not decreased. If a key is pushed in this state, the gate time is decreased and when the gate time becomes zero, the sound attenuated but endured is extinguished. For example, the stop process can be realized by changing the envelope of the sound currently generated and having an endurance time into the envelope quickly attenuating envelope which is used in case of the normal sound generation stopping process. Accordingly, the sound currently generated, and endured while being attenuated is not immediately extinguished even if all the keys are released and the sound generation is maintained and the sound is completely extinguished in response to the pushing of the next key. In the case, the stop of the sound generation is performed on data in addition to the actual sound generation stop process because the gate time is decreased and becomes zero.

The present invention can be applied to the automatic performance apparatus in place of or in addition to the first embodiment. For example, when all keys are released, the first embodiment is applied and when the sound generation process is executed based on the next note data, the second embodiment may be applied and vice versa.

Next, the automatic performance apparatus according to the third embodiment of the present invention will be described. The hardware structure of the automatic performance apparatus in the third embodiment is the same as the hardware structure of the automatic performance apparatus in the first embodiment and the processes other than the key release event process are the same as those in the second embodiment. Therefore, only the different points will be described.

(8) KEY RELEASE EVENT PROCESS

Figure 12:
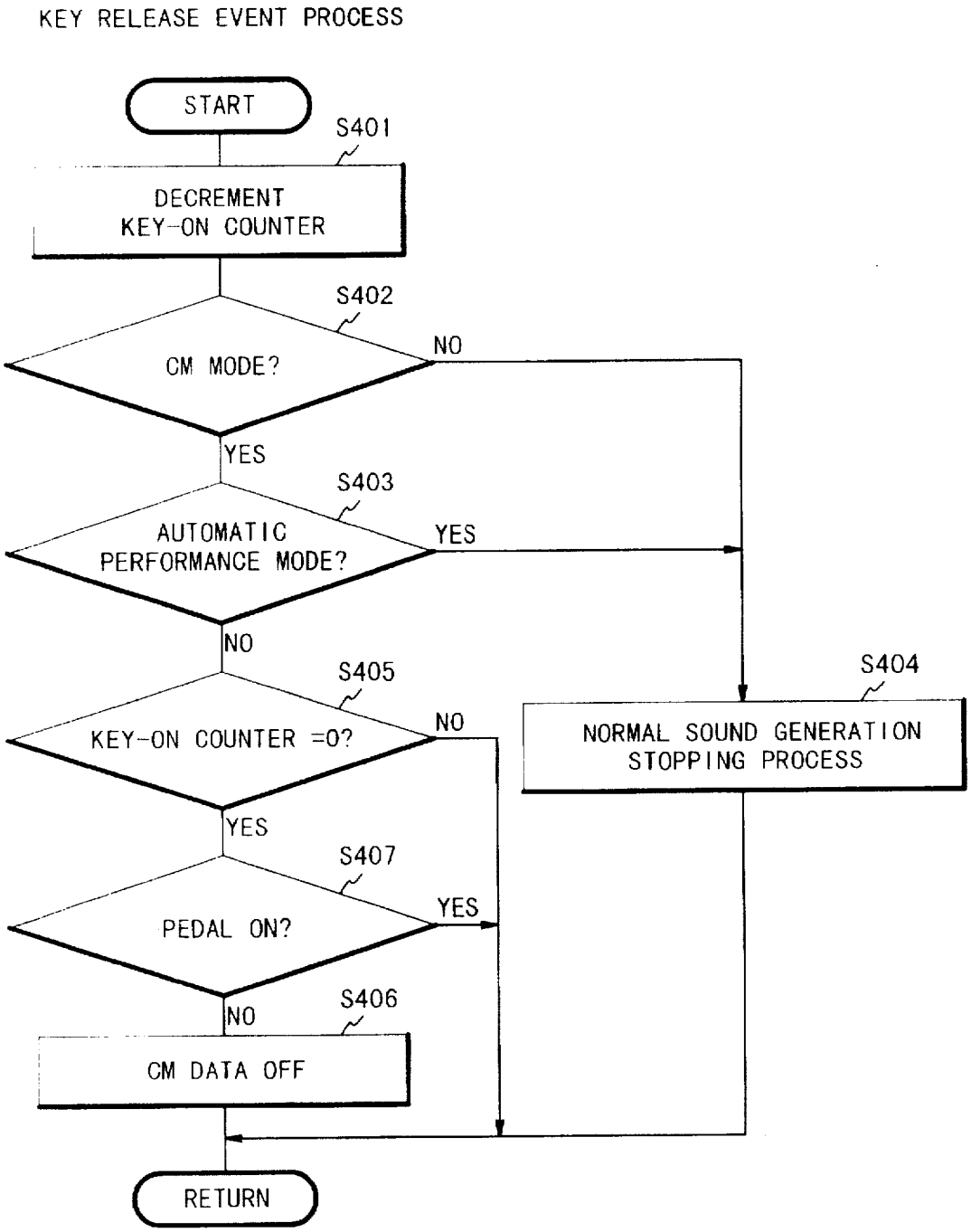
FIG. 12 is a flow chart explaining the operation of the automatic performance apparatus in the key release event process in a third embodiment of the present invention.

FIG. 12 is the flow chart which shows the detail of the key release event process in the third embodiment. Referring to FIG. 12, the processes from step S401 to step S405 are the same as those of step S401 to the step S405 in the second embodiment.

Whether or not the content of the key-on counter is zero is determined in step S405. When the key-on counter is not zero, it is judged that one or more keys are pushed. In this case, because the sound generation is stopped on the sound currently generated when the next key is pushed, the control returns from the key release event process routine to the main process routine without performing any process. That is, the sound generation of the sound currently generated is stopped and the sound generation is started based on the new note data in response to the pushing of the next key if all the keys are not released (if at least one key is pushed) even if the key release event is generated.

When it is judged in step S405 that the content of the key-on counter is zero, it is judged that all the keys are released. Next, whether or not the pedal 26 is set in an on condition is determined (step S407). The determination is executed by checking a pedal flag. The panel interface circuit 14 scans the pedal 26 in addition to the operation panel 15 in the main process routine of FIG. 2. If the pedal 26 is operated at that time, the pedal flag is set. When the pedal 26 is set in the on condition, the control returns from the key release event process routine to the main process routine without performing any process below. That is, if the pedal 26 is operated to the on condition even if the key release event is generated and all the keys are released, the stop of the sound generation is not performed. In this case, when the next key is pushed, the sound generation is started based on the new note data in response to the pushed key and the sound generation of the sound currently generated is stopped. In this manner, the sound is never intermittent even if all the keys are released, resulting in smooth automatic performance.

On the other hand, when it is judged in the above step S407 that the pedal 26 is set in an off state, the CM data off process is executed (step S406). The sound generation stopping process in the CM data off process is the same as the process of the step S406 of FIG. 10. Because the sound generation is stopped by releasing all the keys in the state in which the pedal 26 is set in the off state, the situation that the sound continues to be generated can be avoided. In this manner, the sound generation stopping process is controlled by the operation of the pedal 26.

Note that in the third embodiment, the process for determining whether the sound generation is to be continued or stopped in accordance with the operating state of the pedal 26 when all the keys are released is executed at the time that the key release event is detected, as shown in FIG. 12. Therefore, if a key release event is not generated, the sound generation stopping process is not executed. For example, in the state in which the pedal 26 is operated to the on state, even if the key is released after the key is pushed so that the sound generation is started, the sound generation is continued. The state is a state in which a normal concert magic performance is performed. In order to stop the sound generation such a state, it is necessary to make the key release event generate by pushing and then releasing a key again after the pedal 26 has been set in the off state. It is possible to implement the automatic performance apparatus such that the sound generation is stopped when all the keys are released and the pedal 26 is operated to the off state, in order to avoid such troublesome operation. This can be achieved by detecting that the pedal 26 is set to the off state in the above-mentioned switch event process (step S102 of FIG. 2), and by executing the same process as the CM data off process (step S406) in the above key release event process if the content of the key-on counter is "0" at that time. The off event of the pedal 26 can be detected from the facts that the bit corresponding to the pedal 26 is "1" in the panel event map and that the bit corresponding to the pedal 26 is "0" in the new panel data. According to the structure, the sound generation which is started when the pedal 26 is operated to the on state can be stopped only by operating the pedal 26 to the off state without operating the keyboard unit 17.

In the automatic performance apparatus of the present invention, the same operation as when any key is pushed is performed when the pedal has been set in the on state. That is, in the automatic performance apparatus of the present invention, even if any key is not in the pushed state when a key is released, the sound generation is not stopped but is continued if the pedal is set to the on state. On the other hand, when any key is not in the pushed state, i.e., all the keys are released, the sound generation is stopped if the pedal is set to the off state. Therefore, if a key is pushed or released in the state in which the pedal 26 is set to the off state, the player can play the smooth automatic performance without the sound being intermittent. On the other hand, if all the keys are released in the state in which the pedal 26 is set to the off state, the sound generation is stopped. Therefore, even if the player stops the operation for advancing the automatic performance, i.e., pushing of a key, the sound does not continue to be generated. Thus, the stop of the sound generation can be controlled.

The present embodiment may be applied together with the first embodiment and the second embodiment. Also, in the third embodiment, only the pedal is explained but it is possible to use another switch with the exception of the keys.

Next, the automatic performance apparatus according to the fourth embodiment of the present invention will be described. The hardware structure of the automatic performance apparatus in the fourth embodiment is the same as the hardware structure of the automatic performance apparatus in the first embodiment. Therefore, and the differences between the fourth embodiment and the first embodiment will be described.

(8) KEY PUSH EVENT PROCESS

Figure 13:
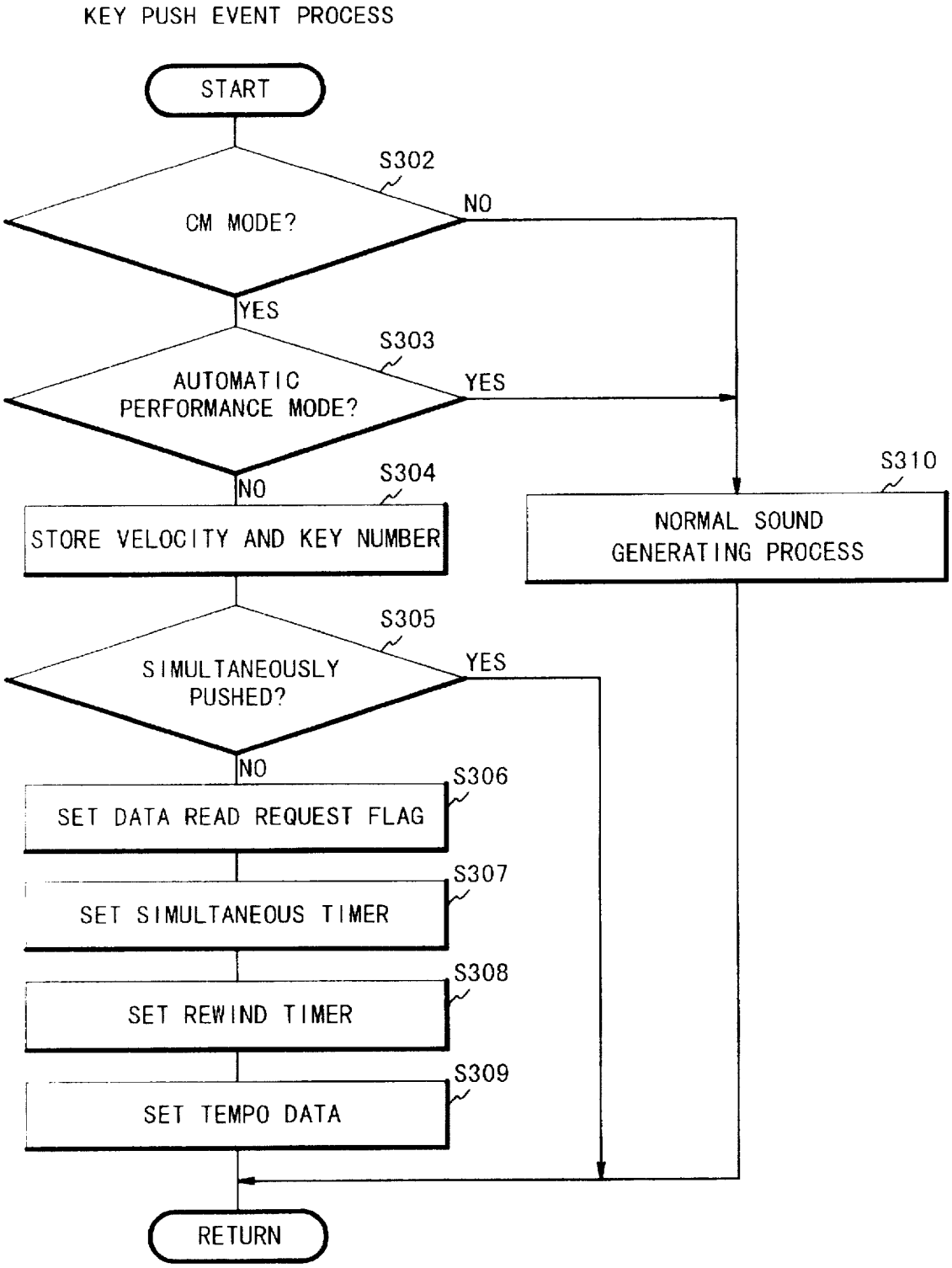
FIG. 13 is a flow chart explaining the operation of the automatic performance apparatus in the key push event process in a fourth embodiment of the present invention.
Figure 14:
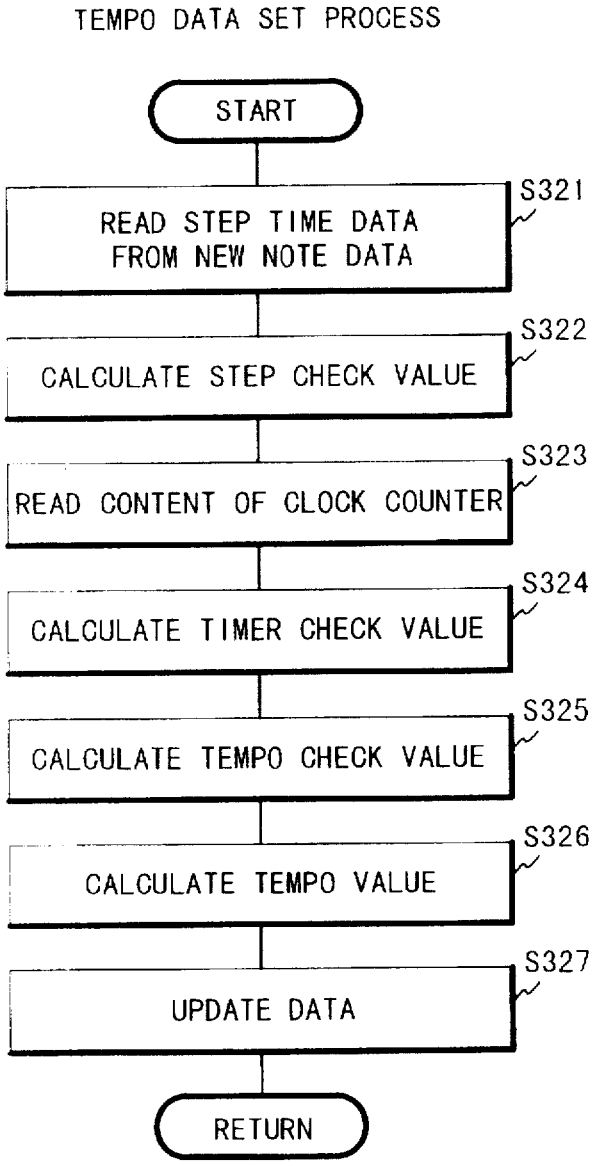
FIG. 14 is a flow chart explaining the operation of the automatic performance apparatus in a tempo data set process in the fourth embodiment of the present invention.

The detail of the key push event process in the fourth embodiment is shown in the flow chart of FIG. 13. The step S301 in which the key-on counter is incremented is omitted in the fourth embodiment, unlike the key push event process of the first embodiment. In the fourth embodiment, the key-on counter is not used for the stop of the sound generation. However, the key-on counter step may be provided. The processes from step S308 to step 308 are same as those in the first embodiment. In the fourth embodiment, after the predetermined time data is set in the rewind timer counter, the tempo data set process is executed in a step S309. The detail of the tempo data set process is shown in the flow chart of FIG. 14.

In the tempo data set process, the step time data of a new note data (which is subjected to the sound generation process in response to the current key push event process) is read out (step S321). The read out step time data is stored in the new step time register which is provided in the work memory 13. Next, a step checking value is calculated (step S322). The step time data (the step time data of the note data for the sound currently generated) which is stored at an old step time register which is provided in the work memory 13, is subtracted from the step time data which is stored in the new step time register. The data which is obtained by the subtraction is used as the step checking value.

Next, the content of the clock counter is read as the clock data (step S323). The read out clock data is stored in a new clock register which is provided in the work memory 13. Next, a timer checking value is calculated (step S324). That is, the clock data which is taken out by the tempo data set process in the last time and is stored in an old clock register which is provided in the work memory 13 (the clock data which is taken out for the sound generation process currently accomplished) is subtracted from the clock data which is stored in a new clock register. The data which is obtained by the subtraction is used as the timer checking value.

Next, the tempo checking value is calculated (step S325). For example, the tempo checking value can be calculated using the following equation (1).

$$\text{(Tempo checking value)} = \text{(step checking value)} \times K/\text{(The timer checking value)} \quad (1)$$

where K is a predetermined number to adjust the tempo checking value into a suitable size. The tempo checking value which is calculated based on the equation (1) shows a step time value for the unit time. Therefore, the tempo can be calculated based on the tempo checking value. Note that the method of finding the tempo checking value is not limited to the method by the equation (1) and any method can be used in which a ratio of the step checking value and the timer checking value can be calculated.

Next, a tempo value is calculated (step S326). For example, the calculation of the tempo value can be determined by quantizing the tempo checking value which is calculated in the above equation (1) at the suitable width and by referring to a table based on the quantized value. In the table, the tempo value is prestored in correspondence to each value which should be quantized. The table is prestored in program memory 12. Note that the tempo value may be calculated using a predetermined calculation equation regardless of the table reference. The tempo value which is calculated in the step S326 is preferably set to a value slightly greater than an accurate tempo value which is calculated from the step check value and the timer check value in order to prevent sound from being intermittent because in variation of the key push intervals.

The tempo value which has been calculated in this manner is stored at the tempo register which is provided in the work memory 13. The content of the tempo register is referenced to judge whether or not the content of the clock counter reaches the predetermined value, in the above-mentioned timer interrupt process (step S203 of FIG. 3). Next, the data update process is executed (step S327). That is, the content of the new step time register is moved to the old step time register, and the content of the new clock register is moved to the old clock register. Thus, the data are prepared for the tempo data set process in the next key push event process. After that, the control returns from the tempo data set process routine to the key push event process routine and then from the key push event process routine to the main process routine.

(9) KEY RELEASE EVENT PROCESS

Figure 15:
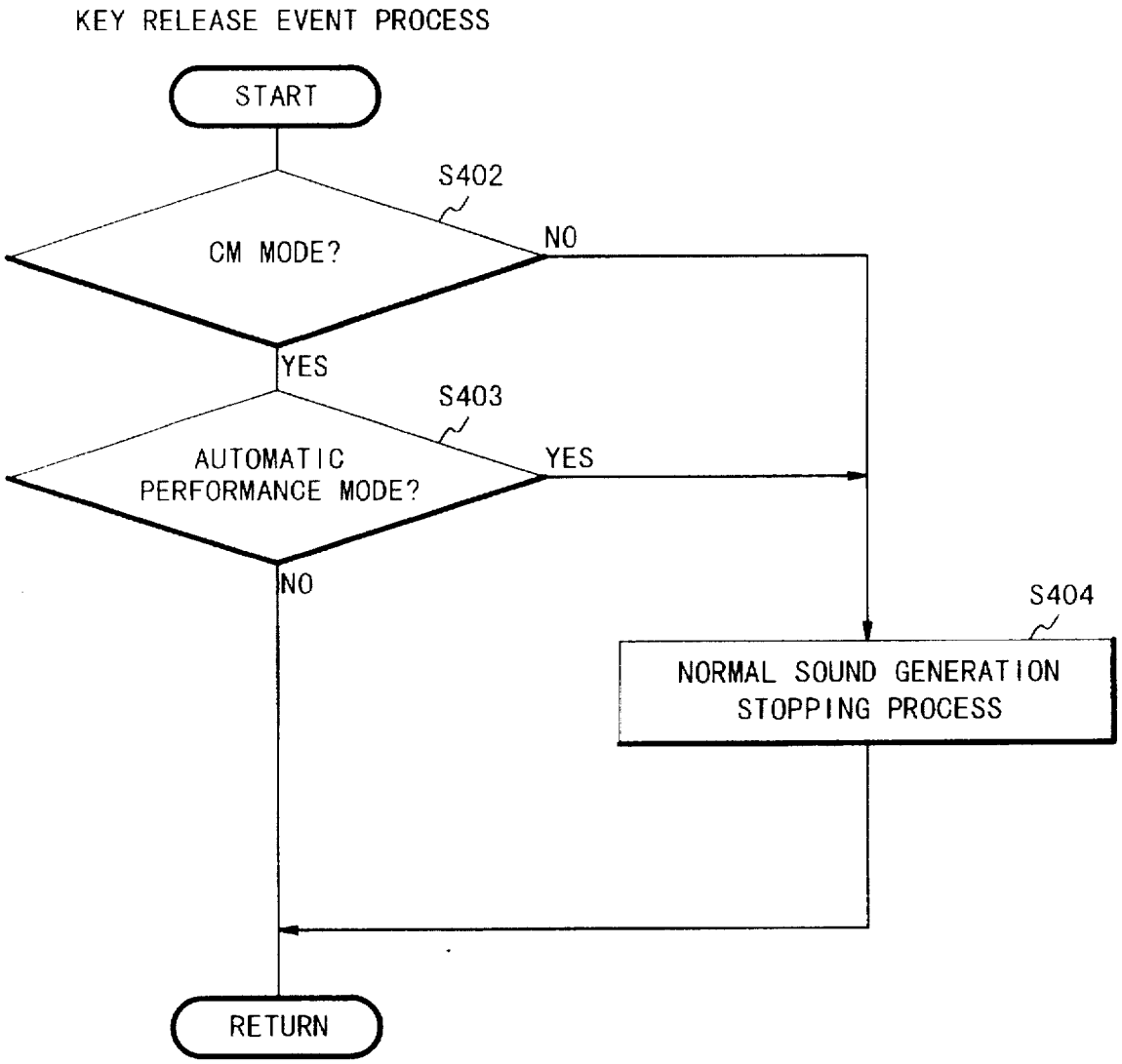
FIG. 15 is a flow chart explaining the operation of the automatic performance apparatus in the key release event process in the fourth embodiment of the present invention.

The detail of the key release event process is shown in the flow chart of FIG. 15. In the key release event process in the fourth embodiment, the step S401 in which the key-on counter is decremented is omitted, unlike the flow chart of FIG. 5. This is because there is the same reason as in the key push event process. The processes from the step S402 to the step S404 are the same as those shown in FIG. 5.

(10) PERFORMANCE PROCESS

Next, the detail of the performance process which is executed in the step S105 of the main process routine will be described. In the performance process, the processes of the steps S501 and S502 and the steps S507 and S508 are the same as those in the performance process of FIG. 6. However, the processes from the step S503 to the step S506 are deleted. Instead, the following processes are added.

After the process of step S508, whether or not the key is pushed, i.e., whether or not the data read request flag is "1" is determined (step S509). It is judged that the key is not pushed when it is judged that the data read request flag is "0" and the process for stopping the sound generation is executed in accordance with the gate time (steps S521 to S525). In this process, the gate time of the note data to the sound currently generated is decremented every step time (the time interval which is proportional to the tempo) and the process for stopping the sound generation is executed when the gate time becomes zero. That is, whether or not the content of the read timing counter is zero is first determined (step S521). When the content of the read timing counter is zero, the control returns from the performance process routine to the main process routine without performing any process. The fact that the content of the read timing counter is zero means not checking timing. In other words, it means that the time period for the one step time does not elapse from the checking timing in the last time and the control does not reach the timing in which the gate time is decremented.

The performance process routine is repeatedly executed in the main process routine and step S521 is executed in the performance process routine if a key is pushed. In parallel, in the timer interrupt process routine, the content of the clock counter is incremented and the content of the read timing counter is incremented when the time period for one step time elapses from the checking timing in the last time (See FIG. 3). Therefore, it is judged in step S521 that the content of the read timing counter is zero when the time period for one step time elapses from the checking timing in the last time. When it is judged in the step S521 that the content of the read timing counter is not zero, the gate-off process is executed (step S522). In the gate-off process, the channel which is currently subjected to the sound generation from among a plurality of channels is searched. The gate time is decremented if there is a channel currently subjected to sound generation and as a result, the sound generation stopping process is executed if the gate time becomes zero. Because the gate-off process routine is called when the control reaches the checking timing, there is realized the function that the gate time is decremented every time interval which is proportional to the tempo, i.e. every step time and as a result of the decrement the sound generation is stopped. The detail of the gate-off process is the same as the processes shown in the flow chart of FIG. 8. Therefore, the detailed explanation of the gate-off process is omitted.

Figure 16:
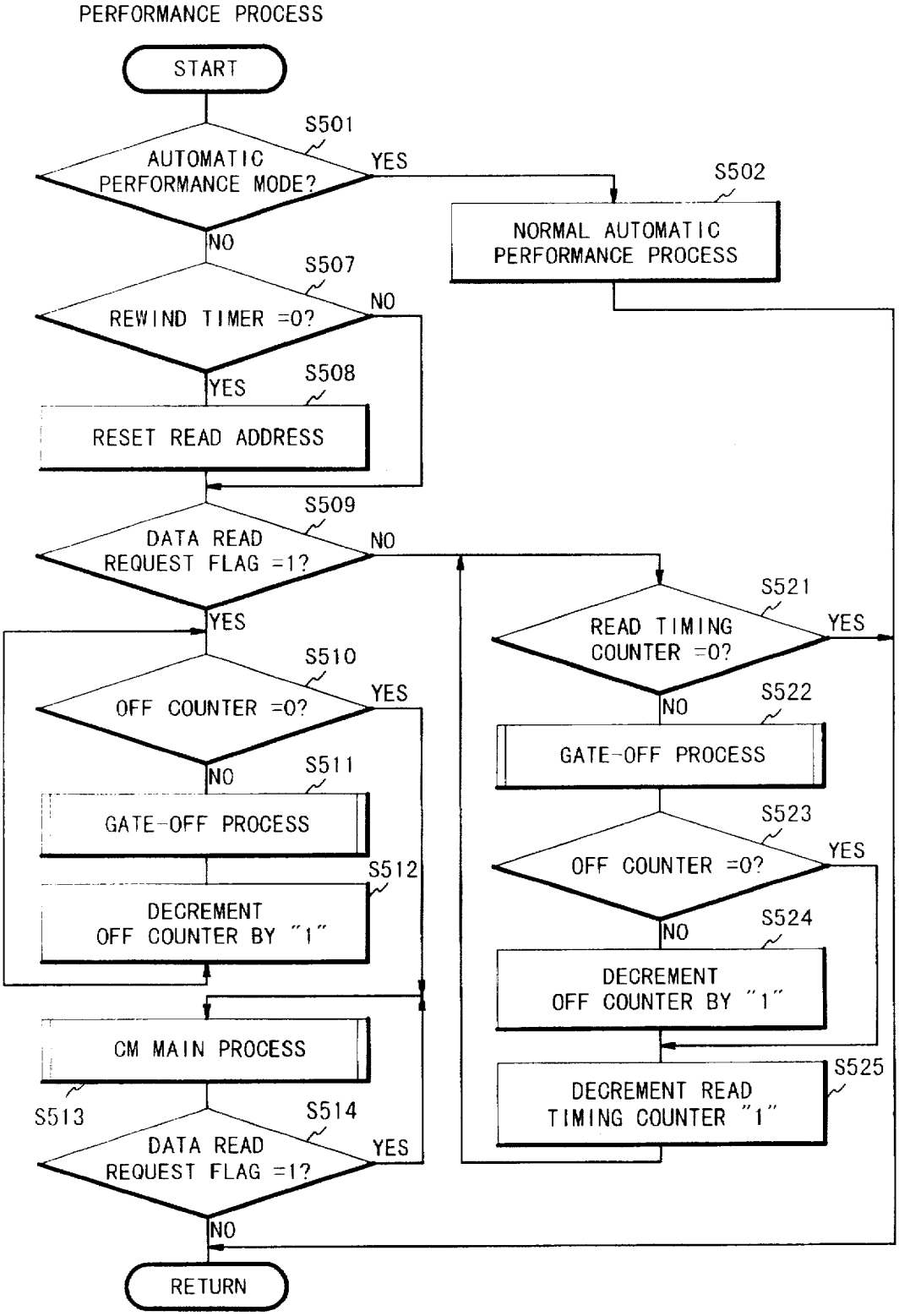
FIG. 16 is a flow chart explaining the operation of the automatic performance apparatus in the performance process in the fourth embodiment of the present invention.

The concert magic performance process (FIG. 16) is continued. Next, when the gate-off process (step S522) is ended, whether or not the content of an off counter is zero is determined (step S523). The content of the off counter is decremented when it is judged that the off counter is not zero (step S524). On the other hand, when it is judged that the off counter is zero, the process of a step S524 is skipped. Note that the off counter is set in the main concert magic process to be mentioned later.

Next, the content of the read timing counter is decremented (step S525). After that, the control returns to the step S521 and the same processes are repeated. Note that generally, the content of the read timing counter becomes only "+1" but when any process takes a great deal of time, the content of the read timing counter becomes "+2" or above. In this case, the processes from step S525 to the step S521 are repeated plural times. In this manner, the time period required until the gate time reaches zero is controlled to the time period as specified by the gate time data. In the way, by the processes from the step S521 to the step S525, the sound generation started started is continued only during the time interval determined in accordance with the gate time corresponding to the note data and then the sound generation is stopped after that. Therefore, even if the operation that the automatic performance is advanced is stopped on the way of the music, the sound does not continue to be generated. Also, when all the keys are released, because the sound for the sound generation is already started and is never extinguished at once at the timing of the release, the problem of the sound being intermittent and affecting smooth performance cannot be achieved is solved.

On the other hand, when it is judged in the above step S509 that the data read request flag is "1", it is judged that the key is pushed and the sound generation process is executed based on the note data (steps S510 to S514). In the process, whether or not the off counter is zero is first determined (step S510). The gate-off process is executed when it is judged the off counter is not zero (step S511). The process is the same as that which has been executed in the above-mentioned step S522. The gate time of the sound currently generated is decremented.

Next, the content of the off counter is decremented (step S512) and the control returns to step S510 after that. Hereinafter, the processes from the step 510 to the step S512 are repeated until the content of the off counter becomes zero. When the key is earlier earlier than the original sound generation timing, the gate time is decremented at high speed for a time interval due to early pushing of the key by the repetitive processes. Therefore, the speed of the performance can be increased.

When it is judged in the step S510 that the off counter becomes zero, the concert magic main process is executed (step S513). The concert magic main process is the process for reading a note data from the automatic performance data memory 18 and generating the sound. The detail of the concert magic main process will be explained with reference to the flow chart of FIGS. 17A and 17B. Here, the processes from step 701 to step 712 are the same as the concert magic main process in the first embodiment shown in FIG. 7. Therefore, the explanation is omitted.

The read address of the following note data is set in the address register in a step S712. Next, whether or not step times are coincident is determined (step S713 of FIG. 17B). On the other hand, when it is judged in the above step S713 that the step times are not coincident, the computation process of the step value which should be set in the off counter is executed (steps S714 to S718). In the computation process of the step value, the content of the step time counter is first stored (step S714). The content of the step time counter can be stored in a save area of the work memory 13. Next, whether or not the step times are coincident is determined (step S715). The content of the step time counter is incremented by "1" if both are not coincident (step S716). Next, the content of the off counter is incremented by "1" (step S717). After that, the control returns to step S715 and the processes of the above the steps S715 to S717 are repeated until step times are coincident. When it is judged in the step S715 that the step times are coincident, the content of the step time counter which is stored in the step S714 is restored (step S718). After that, the control returns to step S701 and the same processes are repeated. The step value for the following sound generation is set in the off counter. Because the off counter is used only in a mode other than the automatic performance mode, the processes of the steps S713 to S718 are not executed in the automatic performance mode, and if the process of step S712 is ended, the control may be constituted such that it returns to step S701.

When the above concert magic main process is ended, the control returns to the step S514 of the concert magic performance process and whether or not the data read request flag is "1" is determined. When the sound generation process is once executed in the concert magic main process, the data read request flag is cleared in the step S711. When the data read request flag is "1", the control returns to the step S513 and the concert magic main process is executed once again. This is the sequence when the data which is earlier processed in the concert magic main process routine is not the note data (the data read request flag is not cleared). Thus, the function that at least one sound is always generated by pushing a key once is ensured. When in the step S514 the data read request flag is "0", the control returns from the concert magic performance process routine to the main process routine.

In the automatic performance apparatus of the present invention, although the start of the sound generation is executed by an instruction from the player (pushing a key), the sound generated by starting the sound generation once is extinguished when the gate time of the note data which corresponds to the sound is decremented in the time interval proportional to the tempo and the gate time becomes zero, like the case of the conventional automatic performance apparatus. For example, as "the time interval proportional to the tempo", the one step time can be used. Therefore, the sound currently generated can be extinguished when there elapses the time period specified by the gate time of the note data, based on which the sound generation is executed. Therefor, the sound does not continue to be generated even if the player stops the operation for advancing the automatic performance on the way of the music. On the contrary, even if all the keys are released, the sound currently generated is not extinguished until there elapses the time period specified by the gate time of the note data based on which the sound generation is being performed. Therefore, the sound never intermits even if the automatic performance is performed using only one key so that smooth automatic performance can be achieved.

Also, once the sound generation is started, when he decrement of the step value and gate time is started in response to the time interval which is proportional to the tempo and when the gate time becomes zero the sound generation is stopped. However, when a new key pushing operation is detected during the above decrement, the sound generation is started based on the new note data. That is, if the step value is not "0" (this state occurs when a key is pushed earlier than the original sound generation timing) when the new key pushing is detected, the decrement is started from step value and gate time at the timing when the key pushing is detected. The decrement is executed at high speed, irrespective of the time interval which is proportional to the above tempo. Then, the sound generation is started based on the following new note data when the step value becomes zero by the decrement. At this time, the sound currently generated is extinguished if the gate time becomes zero during the above decrement.

Because the gate time is adjusted (shortened) such that the gate time is the same as the case where the key pushing is done in the original sound generation timing even if the player pushes a key earlier than the original sound generation timing, when the sound generation of the next new sound is started, there can be avoided the situation that the sound currently generated has been left without being extinguished and that the sounds overlap. Note that although the sound generation is continued if the gate time does not become zero by the above decrement, in a case where the automatic performance data is made to generate the sounds equal to or more than 2 sounds, there is no problem that the sound currently generated and the sound newly generated overlap.

On the other hand, if the step value is "0" (this state occurs when a key is pushed later than the original sound generation timing) when the key pushing is detected, the sound generation is started based on the new note data at once. In this case, because the sound which should be extinguished based on the sound generation timing is already extinguished, the sound which is newly generated never overlaps with the newly generated sound already. Note that even if the sound generation of the sound is continued at the sound generation timing, in a case where the automatic performance data is made to generate the sounds equal to or more than 2, there is no problem in that the sound overlaps the newly generated sound.

The tempo which is calculated in step S326 of the tempo data set process is reflected to "the time interval which is proportional to the tempo". Therefore, the time period required until the generated sound is extinguished is always corrected in accordance with the key pushing time interval by the player. In other words, if the sound generation timing specified by the player is shifted from the original sound generation timing, because the tempo is corrected in accordance with the shifted timing, it is made possible to play the automatic performance as intended by the player. Also, as described above, although there occurs the situation that the sound breaks off earlier when the key pushing is performed later than the original sound generation timing, this would be solved by modifying the calculated tempo into a slightly delayed value and by determining "the time interval which is proportional to the tempo" based on the modified tempo. Thereby, there can be avoided the situation that the player takes an excess time interval to push a key so that the key push event is generated late.

Note that the fourth embodiment may be applied together with either of the third to third embodiments or with a combination of them.

As described above in detail, according to the present invention, the sound does not continue to be generated even if the player stops the operation for advancing the automatic performance on the way of the music. Also, there can be provided the automatic performance apparatus and the method of automatically performing in which smooth automatic performance can be achieved even if only one key is used.

Further, although the present invention is described taking as an example a case where the keyboard unit is applied to one sequence of note data, when a plurality of keys of the keyboard unit are grouped for a plurality of sequences of note data, the present invention may be applied to each of the sequences of note data.

What is claimed is:

1. An automatic performance apparatus with a concert magic function, comprising:

storage means for storing automatic performance data composed of a sequence of note data, each note data including a data of gate time and a data of step time;

a keyboard unit which has a plurality of keys;

sound generating means for starting generation of a sound corresponding to a current note data of the sequence in response to a sound generating instruction, and for stopping the sound generation after a predetermined time interval equal to or longer than the gate time of said current note data corresponding to the generated sound in response to an sound generation stopping instruction;

generation instructing means for sequentially reading out the note data from said storage means in response to an operation of at least one of keys of said keyboard unit corresponding to said sequence of note data, and for issuing the sound generating instruction to said sound generating means in accordance with the step time of the read out note data as said current note data; and key monitoring means for detecting a number of keys of said keyboard unit which are pushed, and for issuing the sound generation stopping instruction to said sound generating means when all the keys corresponding to said sequence of note data are released.

2. An automatic performance apparatus according to claim 1, wherein said sound generating means includes:

time monitoring means for monitoring a time elapse from the start of the sound generation for said current note data to the gate time of said current note data; and means for stopping said sound generation in response to said sound generation stopping instruction when said time monitoring means detects the time elapse by the gate time.

3. An automatic performance apparatus according to claim 1, wherein said sound generating means includes means for applying to said generated sound, an attenuated envelope with a release time of said predetermined time interval in response to said sound generation stopping instruction to stop said sound generation.

4. An automatic performance apparatus according to claim 3, wherein said sound generating means further includes means for, when the attenuated envelope is applied to said generated sound in response to said sound generation stopping instruction, and when it is detected by said key monitoring means that at least one of the keys of said keyboard unit corresponding to said sequence of note data is pushed, stopping said sound generation of said generating sound to which the attenuated envelope is applied, in accordance with the gate time of said current note data.

5. An automatic performance apparatus according to claim 1, further comprising inhibiting means for inhibiting that said key monitoring means issues said sound generation stopping indication.

6. An automatic performance apparatus according to claim 5, wherein said inhibiting means includes a switch element other than said plurality of keys of said keyboard unit.

7. An automatic performance apparatus according to claim 6, wherein said switch element is a pedal.

8. An automatic performance apparatus according to claim 1, wherein said sound generating means starts the sound generation based on the step time of said current note data using a reference time period which is defined based on a tempo and stops the sound generation based on the gate time of said current note data, and wherein said automatic performance apparatus further includes reference time period changing means for, when it is detected by said key monitoring means that at least one of the keys of said keyboard unit corresponding to said sequence of note data is pushed, determining said tempo in accordance with a timing when said at least one key is pushed, and for changing the reference time period based on the determined tempo.

9. An automatic performance apparatus according to claim 8, wherein said sound generating means further includes means for, when said sound generating instruction is not issued and when the reference time period is changed by said reference time period changing means, adjusting a time interval required until the sound generation of said generated sound is stopped, to correspond to the changed reference time period.

10. An automatic performance apparatus according to claim 8, wherein said sound generating means further includes means for, when said sound generating instruction is not issued and when the reference time period is changed by said reference time period changing means, adjusting a time interval required until the sound generation of said generated sound is stopped, to correspond to the changed reference time period, and for generating sounds corresponding to a next note data and subsequent note data using the changed reference time period.

11. An automatic performance apparatus with a concert magic function, comprising:

storage means for storing automatic performance data composed of a sequence of note data, each note data including a data of gate time and a data of step time;

a keyboard unit which has a plurality of keys;

sound generating means for starting generation of a sound corresponding to a current note data of the sequence in response to a sound generating instruction, and for stopping the sound generation while attenuating a sound volume of said generated sound over a predetermined time interval equal to or longer than the gate time of said current note data corresponding to the generated sound in response to an sound generation stopping instruction;

generation instructing means for sequentially reading out the note data from said storage means in response to an operation of at least one of keys of said keyboard unit corresponding to said sequence of note data, and for issuing the sound generating instruction to said sound generating means in accordance with the step time of the read out note data as said current note data; and key monitoring means for detecting a number of keys of said keyboard unit which are pushed, and for issuing the sound generation stopping instruction to said sound generating means when all the keys corresponding to said sequence of note data are released.

12. An automatic performance apparatus according to claim 11, wherein said sound generating means includes means for applying to said generated sound, an attenuated envelope with a release time of said predetermined time interval in response to said sound generation stopping instruction to stop said sound generation.

13. An automatic performance apparatus according to claim 12, wherein said sound generating means further includes means for, when the attenuated envelope is applied to said generated sound in response to said sound generation stopping instruction, and when it is detected by said key monitoring means that at least one of the keys of said keyboard unit corresponding to said sequence of note data is pushed, stopping said sound generation of said generating sound to which the attenuated envelope is applied, in accordance with the gate time of said current note data.

14. An automatic performance apparatus according to claim 11, further comprising inhibiting means for inhibiting that said key monitoring means issues said sound generation stopping indication.

15. An automatic performance apparatus according to claim 14, wherein said inhibiting means includes a switch elements, other than said plurality of keys of said keyboard unit, operated by a foot of a user.

16. An automatic performance apparatus according to claim 8, wherein said sound generating means starts the sound generation based on the step time of said current note data using a reference time period which is defined based on a tempo and stops the sound generation based on the gate time of said current note data, and wherein said automatic performance apparatus further includes reference time period changing means for, when it is detected by said key monitoring means that at least one of the keys of said keyboard unit corresponding to said sequence of note data is pushed, determining said tempo in accordance with a timing when said at least one key is pushed, and for changing the reference time period based on the determined tempo, and wherein said sound generating means further includes means for, when the reference time period is changed by said reference time period changing means, for generating sounds corresponding to a next note data and subsequent note data using the changed reference time period in response to said sound generating instruction.

17. An automatic performance apparatus with the concert magic function comprising:

storage means for storing automatic performance data composed of a sequence of note data, each note data including a data of gate time and a data of step time;

a keyboard unit which has a plurality of keys;

sound generating means for starting generation of a sound corresponding to a current note data of the sequence in response to a sound generating instruction, and for stopping the sound generation after a predetermined time interval equal to or longer than the gate time of said current note data corresponding to the generated sound in response to an sound generation stopping instruction;

generation instructing means for sequentially reading out the note data from said storage means in response to an operation of at least one of keys of said keyboard unit corresponding to said sequence of note data, and for issuing the sound generating instruction to said sound generating means in accordance with the step time of the read out note data as said current note data;

key monitoring means for detecting a number of keys of said keyboard unit which are pushed, and for issuing the sound generation stopping instruction to said sound generating means when all the keys corresponding to said sequence of note data are released; and inhibiting means for inhibiting said key monitoring means from issuing said sound generation stopping instruction.

18. An automatic performance apparatus according to claim 17, wherein said sound generating means includes:

time monitoring means for monitoring a time elapse from the start of the sound generation for said current note data to the gate time of said current note data; and means for stopping said sound generation in response to said sound generation stopping instruction when said time monitoring means detects the time elapse by the gate time.

19. An automatic performance apparatus according to claim 17, wherein said sound generating means includes means for applying to said generated sound, an attenuated envelope with a release time of said predetermined time interval in response to said sound generation stopping instruction to stop said sound generation.

20. An automatic performance apparatus according to claim 19, wherein said sound generating means further includes means for, when the attenuated envelope is applied to said generated sound in response to said sound generation stopping instruction, and when it is detected by said key monitoring means that at least one of the keys of said keyboard unit corresponding to said sequence of note data is pushed, stopping said sound generation of said generating sound to which the attenuated envelope is applied, in accordance with the gate time of said current note data.

21. An automatic performance apparatus according to claim 17, wherein said inhibiting means is composed of a pedal.

22. An automatic performance apparatus according to claim 17, wherein said sound generating means starts the sound generation based on the step time of a next note data using a reference time period which is defined based on a tempo and stops the sound generation based on the gate time of said current note data, and wherein said automatic performance apparatus further includes reference time period changing means for, when it is detected by said key monitoring means that at least one of the keys of said keyboard unit corresponding to said sequence of note data is pushed, determining said tempo in accordance with a timing when said at least one key is pushed, and for changing the reference time period based on the determined tempo.

23. An automatic performance apparatus with the concert magic function comprising:

storage means for storing automatic performance data composed of a sequence of note data, each note data including a data of gate time and a data of step time;

a keyboard unit which has a plurality of keys;

sound generating means for starting generation of a sound corresponding to a current note data of the sequence in response to a sound generating instruction, and for stopping the sound generation after a predetermined time interval equal to or longer than the gate time of said current note data corresponding to the generated sound in response to an sound generation stopping instruction;

key monitoring means for detecting a number of keys of said keyboard unit which are pushed, and for issuing the sound generation stopping instruction to said sound generating means when all the keys corresponding to said sequence of note data are released;

reference time period setting means for, when it is detected by said key monitoring means that at least one of the keys of said keyboard unit corresponding to said sequence of note data is pushed, determining said tempo in accordance with a timing when said at least one key is pushed, and for setting a reference time period based on the determined tempo; and generation instructing means for reading out said current note data from said storage means when it is detected by said key monitoring means that at least one of keys of said keyboard unit corresponding to said sequence of note data is pushed, and for issuing the sound generating instruction to said sound generating means in accordance with the step time of said current note data.

24. An automatic performance apparatus according to claim 23, wherein said sound generating means further includes means for, when said sound generating instruction is not issued and when the reference time period is newly set by said reference time period setting means, adjusting a time interval required until the sound generation of a currently generated sound is stopped, to correspond to the set reference time period.

25. An automatic performance apparatus according to claim 23, wherein said sound generating means further includes means for, when said sound generating instruction is not issued and when the reference time period is newly set by said reference time period changing means, adjusting a time interval required until the sound generation of a generated sound is stopped, to correspond to the set reference time period, and for generating sounds corresponding to a next note data and subsequent note data using the set reference time period.

26. An automatic performance apparatus according to claim 23, wherein said sound generating means includes:

time monitoring means for monitoring a time elapse from the start of the sound generation for said current note data to the gate time of said current note data; and means for stopping said sound generation in response to said sound generation stopping instruction when said time monitoring means detects the time elapse by the gate time.

27. An automatic performance apparatus according to claim 23, wherein said sound generating means includes means for applying to said generated sound, an attenuated envelope with a release time of said predetermined time interval in response to said sound generation stopping instruction to stop said sound generation.

28. An automatic performance apparatus according to claim 23, wherein said sound generating means further includes means for, when the attenuated envelope is applied to said generated sound in response to said sound generation stopping instruction, and when it is detected by said key monitoring means that at least one of the keys of said keyboard unit corresponding to said sequence of note data is pushed, stopping said sound generation of said generating sound to which the attenuated envelope is applied, in accordance with the gate time of said current note data.

29. An automatic performance apparatus according to claim 23, further comprising inhibiting means for inhibiting that said key monitoring means issues said sound generation stopping indication.

30. A method of automatic performance in an automatic performance apparatus with the concert magic function comprising the steps of:

detecting that all of keys corresponding to a sequence of note data are released;

when it is detected that all of keys corresponding to the sequence of note data are released, stopping sound generation of a currently generated sound after a predetermined time interval equal to or longer than a gate time of a note data corresponding to the currently generated sound;

detecting that at least one of the keys corresponding to the sequence of note data is pushed;

when it is detected that said at least one of the keys is pushed, reading out a next note data of the sequence from storage means; and starting generation of a sound corresponding to the next note data of the sequence based on a step time of the next note data using a preset reference time period.

* * * * *

UNITED STATES PATENT AND TRADEMARK OFFICE

CERTIFICATE OF CORRECTION

PATENT NO. : 5,760,324

DATED : June 2, 1998

INVENTOR(S) : Sadamoto Wakuda; Yoshihisa Shimada

It is certified that error appears in the above-identified patent and that said Letters Patent is hereby corrected as shown below:

In the Abstract, lines 17,18, replace "on the way of performance of a music" with -- during the performance of music --.

In the drawings, FIG. 10, Sheet 10, in block S404 replace "SOURND" with -- SOUND --.

Figure 17A:
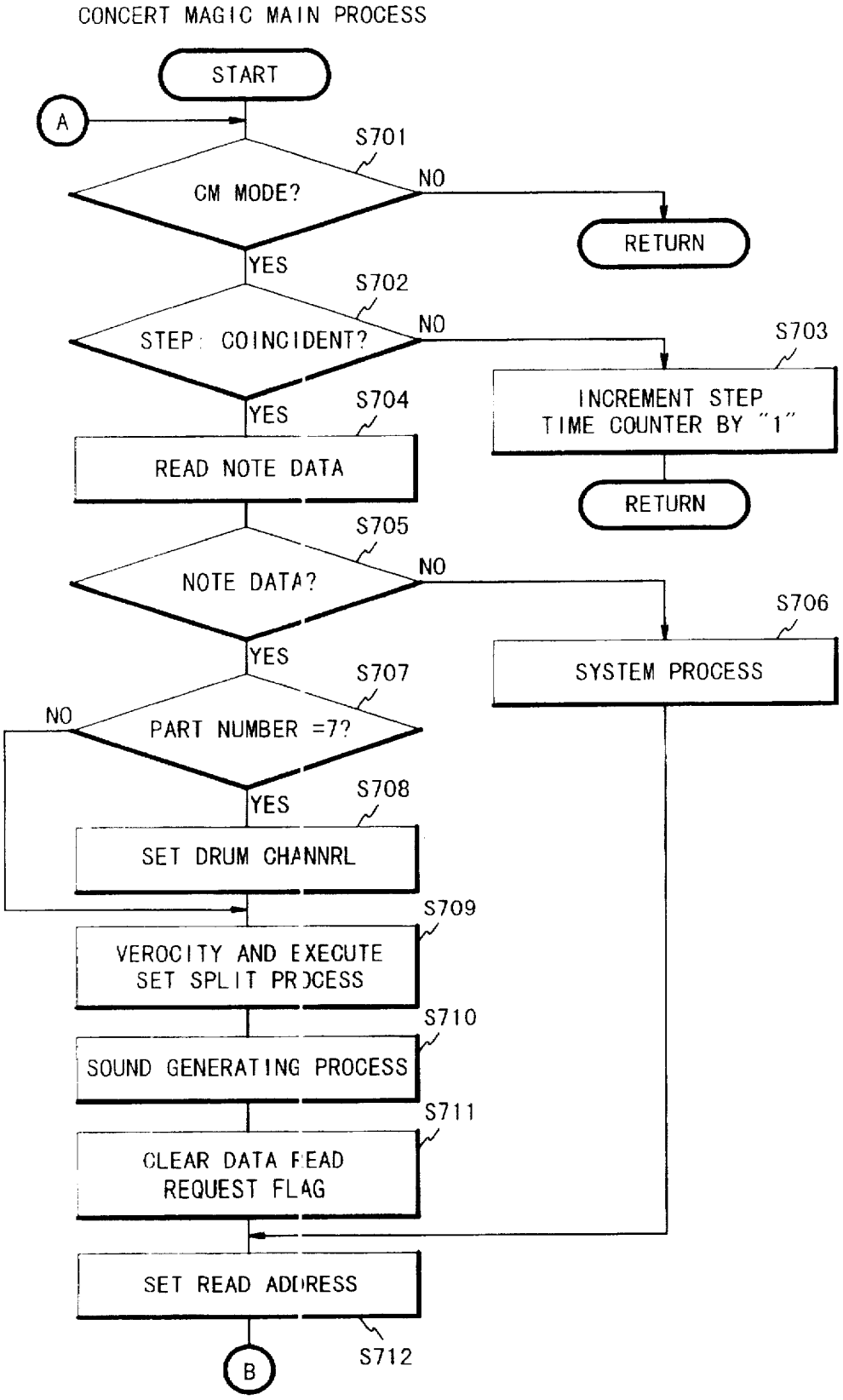
FIGS. 17A and 17B are flow charts explaining the operation of the automatic performance apparatus in the concert magic main process in the fourth embodiment of the present invention.
Figure 17B:
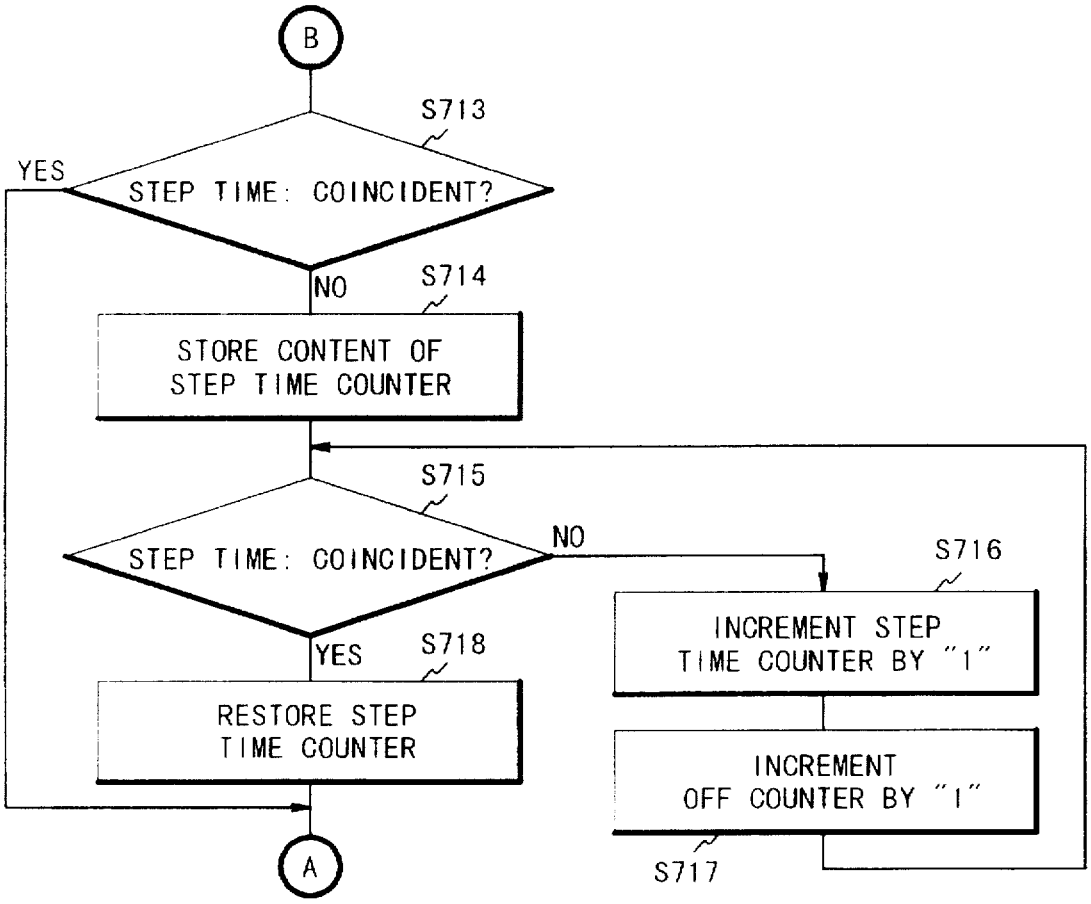

In the drawings, FIG. 17A, Sheet 17, in block S708 replace "CHANNRL" with -- CHANNEL --.

Column 1, line 20, replace "data of" with -- of data corresponding to --.

Column 1, line 20, before "key number" insert -- the --.

Column 2, line 40, after "for the player" insert -- to --.

Column 2, line 62, after "content of" insert -- the --.

Column 3, line 48, replace "intermitted" with -- intermittent --.

Column 5, line 14, between "for" and "adjusting" delete the comma.

Column 8, line 59, change "umber" to -- number --.

Column 10, line 27, after "been" delete "occurred".

Column 11, line 6, after "when" insert -- the --.

Column 14, line 35, replace "two ore more" with -- two or more --.

Column 16, line 3, replace "process are" with -- process is --.

Column 17, line 38, replace "of that the being" with -- of being --.

Column 17, line 65, replace "hereinafter the" with -- then --.

Column 18, line 53, after "such as" delete "and".

Column 18, line 62, replace "dram" with "drum".

Column 19, line 37, change "elapse" to -- elapsed --.

Column 19, line 41, after "it may be" delete "is".

Column 19, line 66, after "step S403" delete "that".

Column 20, line 2, after "is not zero," delete "it is".

UNITED STATES PATENT AND TRADEMARK OFFICE

CERTIFICATE OF CORRECTION

PATENT NO. : 5,760,324
DATED : June 2, 1998
INVENTOR(S) : Sadamoto Wakuda; Yoshihisa Shimada It is certified that error appears in the above-identified patent and that said Letters Patent is hereby corrected as shown below:

Column 21, line 18, after "time into the" delete "envelope".
Column 22, line 39, before "such" insert -- in --.
Column 23, line 34, replace "from step S308 to step 308" with
-- from step S302 to step S308 --.
Column 24, line 27, after "being" insert -- made --.
Column 24, line 28, replace "because in variation of" with
-- because of variation in --.
Column 25, line 63, replace "generation started started" with
-- generation once started --.
Column 26, line 20, replace "step 510" with -- S510 --.
Column 26, line 22, replace "key is earlier earlier" with
-- key is pushed earlier --.
Column 26, line 53, after "above" delete "the".
Column 26, line 54, after "repeated until" insert -- the --.
Column 27, line 26, change "Therefor" to -- Therefore --.
Column 27, line 36, replace "when he" with -- when the --.
Column 28, line 8, replace "newly generated sound already" with
-- already generated sound --.
Column 28, line 64, replace "to an sound" with -- to a sound --.
Column 30, line 24, replace "to an sound" with -- to a sound --.
Column 30, line 60, change "elements"to -- element --.

UNITED STATES PATENT AND TRADEMARK OFFICE

CERTIFICATE OF CORRECTION

PATENT NO. : 5,760,324

DATED : June 2, 1998

INVENTOR(S) : Sadamoto Wakuda; Yoshihisa Shimada

It is certified that error appears in the above-identified patent and that said Letters Patent is hereby corrected as shown below:

Column 31, line 30, replace "to an sound" with -- to a sound --.
Column 32, line 35, replace "to an sound" with -- to a sound --.

Signed and Sealed this

Eleventh Day of April, 2000

*Attest:*

Q. TODD DICKINSON

*Attesting Officer*

*Director of Patents and Trademarks*